US008846279B2

(12) United States Patent
Fujii

(10) Patent No.: US 8,846,279 B2
(45) **Date of Patent: *Sep. 30, 2014**

(54) ELECTROPHOTOGRAPHIC PHOTORECEPTOR, ELECTROPHOTOGRAPHIC PHOTORECEPTOR CARTRIDGE AND IMAGE FORMING APPARATUS

(71) Applicant: Mitsubishi Chemical Corporation, Chiyoda-ku (JP)

(72) Inventor: Akiteru Fujii, Kanagawa (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/783,595

(22) Filed: Mar. 4, 2013

(65) Prior Publication Data

US 2013/0230800 A1 Sep. 5, 2013

(30) Foreign Application Priority Data

Mar. 5, 2012 (JP) ..... 2012-048019

(51) Int. Cl.
*G03G 5/06* (2006.01)
*G03G 5/047* (2006.01)
*G03G 5/05* (2006.01)

(52) U.S. Cl.
CPC ..... *G03G 5/047* (2013.01); *G03G 5/0696* (2013.01); *G03G 5/0614* (2013.01); *G03G 5/0607* (2013.01); *G03G 5/0609* (2013.01); *G03G 5/056* (2013.01)
USPC ..... 430/58.25; 430/58.8; 430/58.75; 430/59.4; 430/59.6; 399/159

(58) Field of Classification Search
CPC . G03G 5/0614; G03G 5/0609; G03G 5/0607; G03G 5/0677
USPC ..... 430/58.25, 58.8, 58.75, 59.4, 59.6
See application file for complete search history.

(56) References Cited

U.S. PATENT DOCUMENTS

| | | | | |
|---|---|---|---|---|
| 5,037,714 | A | 8/1991 | Nozomi et al. | |
| 5,449,580 | A * | 9/1995 | Nakamori et al. | 430/58.25 |
| 5,942,361 | A * | 8/1999 | Hoshizaki et al. | 430/58.7 |
| 6,080,518 | A * | 6/2000 | Levin et al. | 430/58.4 |

FOREIGN PATENT DOCUMENTS

| | | | | |
|---|---|---|---|---|
| JP | 1-206349 | | 8/1989 | |
| JP | 2-230255 | | 9/1990 | |
| JP | 7-281459 | | 10/1995 | |
| JP | 9-281728 | | 10/1997 | |
| JP | 10-20523 | | 1/1998 | |
| JP | 2785354 | | 5/1998 | |
| JP | 10-312069 | | 11/1998 | |
| JP | 2000-221713 | | 8/2000 | |
| JP | 3130382 | | 11/2000 | |
| JP | 2002-351106 | | 12/2002 | |
| JP | 2003316035 | A * | 11/2003 | G03G 5/47 |
| JP | 2006-030975 | | 2/2006 | |

OTHER PUBLICATIONS

English language machine translation of JP 2003-316035 (Nov. 2003).*
U.S. Appl. No. 13/917,105, filed Jun. 13, 2013, Fujii.

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

The invention provides a laminate-type electrophotographic photoreceptor for use in a negative charge system, comprising a conductive support, and a photosensitive layer containing a charge generation layer and a charge transport layer, on the conductive support, wherein in addition to a fluorene compound and a diamine compound which are responsible for charge transport, a compound having a specific structure is used in combination.

8 Claims, 2 Drawing Sheets

ELECTROPHOTOGRAPHIC PHOTORECEPTOR, ELECTROPHOTOGRAPHIC PHOTORECEPTOR CARTRIDGE AND IMAGE FORMING APPARATUS

FIELD of INVENTION

The present invention relates to an electrophotographic photoreceptor excellent in electrical characteristics and resistance to light-induced fatigue, an electrophotographic photoreceptor cartridge manufactured using the electrophotographic photoreceptor, and an image forming apparatus.

BACKGROUND OF INVENTION

Along with general-purpose applications of an electrophotographic technology, an image forming apparatus of an electrophotographic system has come into use in various image forming processes. In particular, to meet the demand for producing high color image quality, a strict requirement for performance stability is imposed, among others, on members used in the electrophotographic process, especially on an electrophotographic photoreceptor (hereinafter, sometimes referred to as "photoreceptor") serving as a core part. Above all, in the case where the light attenuation behavior is not so much governed by the process control, a slight potential variation affects the image density, gradation and color tone and therefore, it is required that electrical and mechanical characteristics are stable throughout the life.

Various disturbance factors affect the performance of the photoreceptor and with respect to so-called light-induced fatigue characteristics such that the chargeability, light attenuation behavior and repetition stability thereof are deteriorated due to exposure of the photoreceptor to external light during coating/after-processing or at the replacement or maintenance, a measure for blocking light as much as possible is sometimes taken from a hardware side, but this is disadvantageous in view of cost and it is most preferred that the photoreceptor itself is basically not subject to light-induced fatigue. On the other hand, most of recent electrophotographic photoreceptors are an organic photoreceptor and cannot be said to have an adequate measure for light-induced fatigue characteristics, and the risk of allowing a slightly produced potential variation to emerge as an image defect is high.

As for the measure against light-induced fatigue of the photoreceptor, various techniques have been heretofore proposed. Patent Document 1 discloses a method of adding a dissimilar charge transport material having a small ionization potential, where the potential variation immediately after exposure to light is decreased but when use is further repeated, the dissimilar charge transport material having a small ionization potential works as a trap for a charge carrier, giving rise to a problem that residual potential is accumulated. Patent Document 2 discloses a technique of improving the repetition stability by the addition of an acceptor compound. In this case, the potential in repeated use is stabilized, but the potential variation (potential reduction) immediately after light irradiation is disadvantageously large. Patent Document 3 discloses a technique of incorporating a compound such as pigment having an absorption peak at 450 to 620 nm into a charge transport layer. However, in the case of adding a known pigment or dye, there exists a problem in terms of dispersion stability in the coating solution or a problem that the side effect such as performance variation and image defect is significant. Patent Document 4 discloses a technique of adding an azo compound having a charge transport function and having a strong absorption in the visible region. In this case, use of the compound is sometimes prohibited depending on the compatibility with various charge transport materials, and the technique cannot be said necessarily to be a versatile technique. Patent Document 5 discloses a technique of adding an ultrafine particle, where blue light is prevented from reaching the inside of the photosensitive layer by a flip-flop effect and the characteristics are less likely to be changed or deteriorated. In this case, the dispersion stability of fine particle in a coating solution is again a problem, and not only the mass production is limited but also the light-shielding effect on the wavelength side longer than blue light cannot be satisfied.

Incidentally, it has been proposed to use a specific fluorene compound and a specific diamine compound in combination for a charge transport material which is one of constituent materials of the photoreceptor, and thereby realize inexpensive production of a photoreceptor excellent in the balance of performances such as high sensitivity, stable potential in repeated use, good crack resistance and less occurrence of transfer memory (Patent Document 6). However, these two kinds of charge transport materials are susceptible to the above-described light-induced fatigue, and there is a problem that in order to prevent an image trouble, for example, control of the light quality in the production line, filtering of short-wavelength light, winding of a light-shielding film around the photoreceptor or installation of a light-shielding mechanism in the cartridge is required, leading to lost productivity and rising cost.

DOCUMENT LIST

[Patent Document 1] JP-A-10-312069 (the term "JP-A" as used herein means an "unexamined published Japanese patent application")
[Patent Document 2] Japanese Patent No. 2785354
[Patent Document 3] JP-A-2002-351106
[Patent Document 4] JP-A-2006-30975
[Patent Document 5] JP-A-7-281459
[Patent Document 6] JP-A-2000-221713
[Patent Document 7] JP-A-9-281728
[Patent Document 8] JP-A-2-230255
[Patent Document 9] JP-A-10-20523
[Patent Document 10] JP-A-1-206349
[Patent Document 11] Japanese Patent No. 3130382

SUMMARY OF THE INVENTION

The present invention has been made by taking into account those problems, and an object of the present invention is to provide an electrophotographic photoreceptor with excellent durability, an electrophotographic cartridge, and an image forming apparatus, ensuring that even when a specific fluorene compound and a specific diamine compound are used in combination, the light-induced fatigue, particularly, the potential variation immediately after exposure to external light, is reduced and at the same time, even when use is thereafter repeated, the rise in residual potential is small.

As a result of intensive studies, the present inventors have found that the light-induced fatigue characteristics are improved by using a compound having a specific structure in combination, in addition to a fluorene compound and a diamine compound which are responsible for charge transport. The present invention described below has been accomplished based on this finding.

The gist of the present invention resides in the following <1> to <5>.

(1) A laminate-type electrophotographic photoreceptor for use in a negative charge system, comprising: a conductive support; and a photosensitive layer containing a charge generation layer and a charge transport layer, on the conductive layer, wherein the charge transport layer contains a charge transport substance represented by the following formula (2), a charge transport substance represented by the following formula (6) and at least one of compounds represented by (5a) to (5c), in the same layer:

(2)

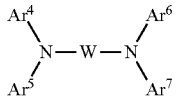

wherein each of $Ar^4$ to $Ar^7$ independently represents an aryl group having a carbon number of 30 or less, which may have a substituent, and W represents a divalent substituent represented by the following formula (3) or (4);

(3)

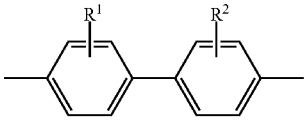

(4)

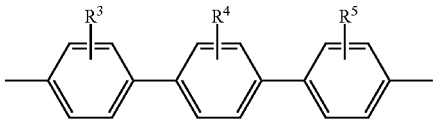

wherein each of $R^1$ to $R^5$ independently represents a hydrogen atom or an alkyl group having a carbon number of 6 or less, and the substituents in $Ar^4$ to $Ar^7$ may combine with each other to form a ring;

(6)

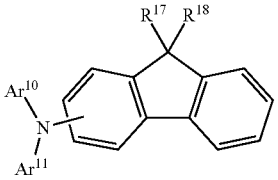

wherein each of $Ar^{10}$ and $Ar^{11}$ independently represents an aryl group having a carbon number of 30 or less, which may have a substituent, and each of $R^{17}$ and $R^{18}$ independently represents a hydrogen atom or an alkyl group having a carbon number of 6 or less;

(5a)

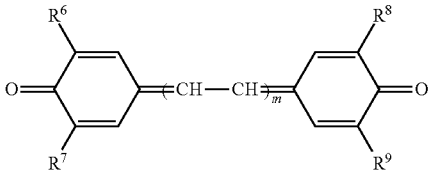

wherein each of $R^6$ to $R^9$ independently represents an alkyl group having a carbon number of 6 or less, and m represents 0 or 1;

(5b)

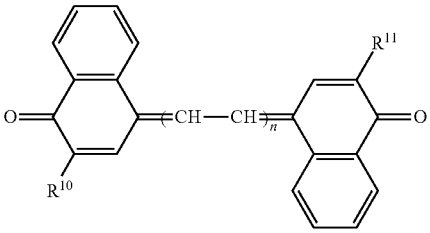

wherein each of $R^{10}$ and $R^{11}$ independently represents an alkyl group having a carbon number of 6 or less, and n represents 0 or 1;

(5c)

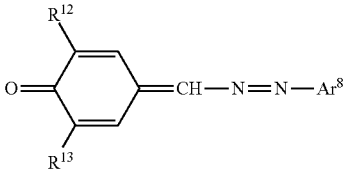

wherein each of $R^{12}$ and $R^{13}$ independently represents an alkyl group having a carbon number of 6 or less, and $Ar^8$ represents an aryl group having a carbon number of 30 or less, which may have a substituent.

(2) The laminate-type electrophotographic photoreceptor as described in the item (1) above, wherein the photosensitive layer contains a polyester resin having a structural unit represented by the following formula (7):

(7)

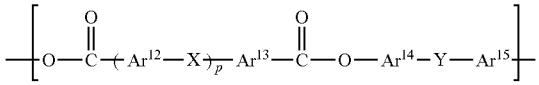

wherein each of $Ar^{12}$ to $Ar^{15}$ independently represents an arylene group which may have a substituent, X represents a single bond, an oxygen atom, a sulfur atom or an alkylene group, p represents an integer of 0 to 2, and Y represents a single bond, an oxygen atom, a sulfur atom or an alkylene group.

(3) The laminate-type electrophotographic photoreceptor as described in the item (1) or (2) above, wherein the photosensitive layer contains gallium phthalocyanine as a charge generating substance.

(4) An electrophotographic photoreceptor cartridge comprising: the laminate-type electrophotographic photoreceptor described in any one of the items (1) to (3) above; and at least one member selected from the group consisting of a charging device for charging said electrophotographic photoreceptor, an exposure device for exposing said charged laminate-type electrophotographic photoreceptor to form an electrostatic latent image, and a developing device for developing the electrostatic latent image formed on said laminate-type electrophotographic photoreceptor.

(5) An image forming apparatus comprising: the laminate-type electrophotographic photoreceptor described in any one of the items (1) to (3); a charging device for charging said laminate-type electrophotographic photoreceptor; an exposure device for exposing said charged laminate-type electrophotographic photoreceptor to form an electrostatic latent image; and a developing device for developing the electrostatic latent image formed on said laminate-type electrophotographic photoreceptor.

In the present invention, two kinds of charge transport substances each having a specific structure and an additive are incorporated into the photosensitive layer, whereby an electrophotographic photoreceptor being resistant to light-induced fatigue and excellent in durability and exhibiting stable performances throughout the life, an electrophotographic photoreceptor cartridge, and an image forming apparatus can be provided.

DESCRIPTION OF REFERENCE NUMERALS AND SIGNS

Figure 1:
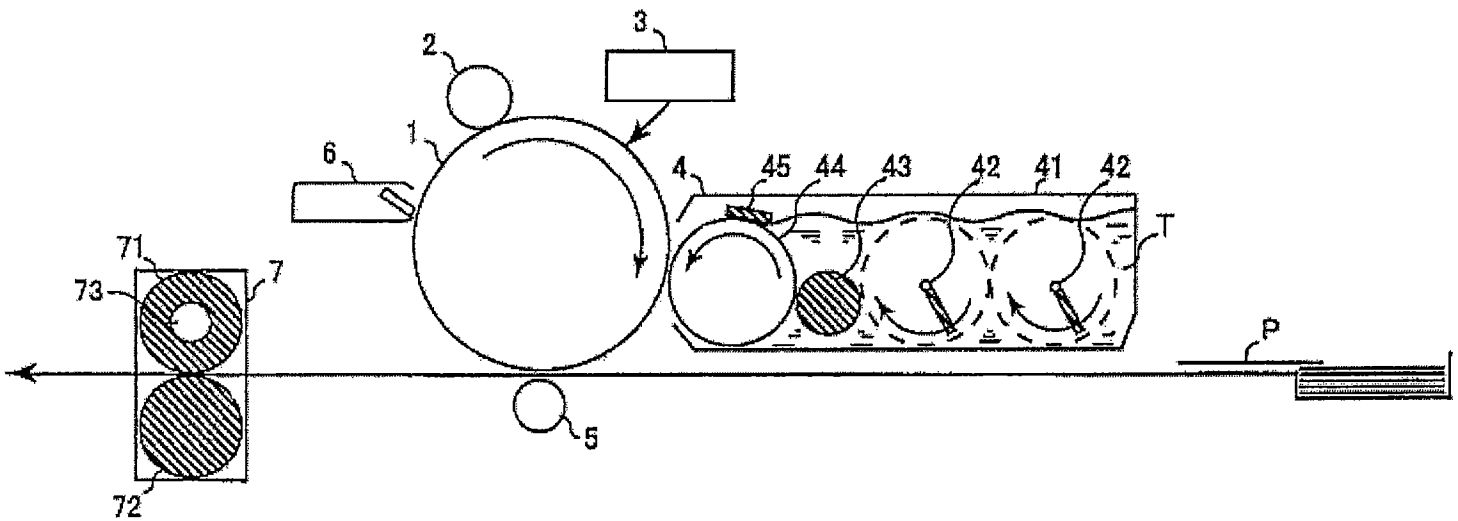
FIG. 1 is a schematic view illustrating the configuration of main parts in one embodiment of the image forming apparatus of the present invention.

1 Photoreceptor (electrophotographic photoreceptor)
2 Charging device (charging roller; charging unit)
3 Exposure device (exposure unit)
4 Developing device (developing unit)
5 Transfer device
6 Cleaning device
7 Fixing device
41 Developing tank
42 Agitator
43 Feed roller
44 Developing roller
45 Regulating member
71 Upper fixing member (fixing roller)
72 Lower fixing member (fixing roller)
73 Heating device
T Toner
P Recording paper (paper, medium)

DETAILED DESCRIPTION OF THE INVENTION

The mode for carrying out the present invention is described in detail below. However, the constituent requirements described below are representative examples of the embodiment of the present invention, and the present invention can be implemented by making appropriate modifications therein without departing from the purport of the present invention.

<Charge Transport Substance of the Present Invention>

The compounds represented by the following formulae (2) and (6) are the charge transport substance of the present invention and are mixed and used in the same layer.

(6)

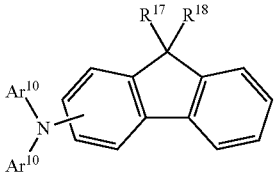

In formula (6), each of $Ar^{10}$ and $Ar^{11}$ independently represents an aryl group having a carbon number of 30 or less, which may have a substituent, and each of $R^{17}$ and $R^{18}$ independently represents a hydrogen atom or an alkyl group having a carbon number of 6 or less. $Ar^{10}$ and $Ar^{11}$ each independently represents an arylene group having a carbon number of 30 or less, which may have a substituent. The carbon number of the aryl group is 30 or less, preferably 20 or less, more preferably 15 or less. Specific examples thereof include a phenyl group, a naphthyl group, an anthranyl group, and a pyrenyl group. In view of synthesis, a phenyl group or a naphthyl group is preferred, and a phenyl group is most preferred. The total carbon number of the substituents which may be substituted on $Ar^{10}$ and $Ar^{11}$ is 30 or less and in view of solubility and synthesis, preferably 20 or less, more preferably 10 or less. Specific examples of the substituent include an alkyl group, an alkoxy group, an amino group, and an aryl group, and among these, in view of electrical characteristics, an alkyl group is preferred. The carbon number of the alkyl group is 10 or less, preferably 6 or less, more preferably 4 or less. The substitution position is preferably the ortho-position with respect to the nitrogen atom in view of light-induced fatigue and is preferably the para-position in view of electrical characteristics.

In $R^{17}$ and $R^{18}$, the carbon number of the alkyl group is 6 or less, preferably 4 or less, more preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group or an ethyl group is preferred, and a methyl group is most preferred. In view of chemical stability, $R^{17}$ and $R^{18}$ are preferably both an alkyl group having a carbon number of 6 or less, more preferably both an alkyl group having a carbon number of 4 or less, and most preferably both a methyl group.

(2)

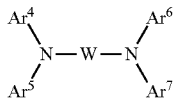

In formula (2), W represents a divalent substituent represented by formula (3) or (4). Each of $R^1$ to $R^5$ represents a hydrogen atom or an alkyl group having a carbon number of 4 or less. In $R^1$ to $R^5$, the carbon number of the alkyl group is 4 or less, preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group or an ethyl group is preferred, and a methyl group is most preferred. The substitution number of alkyl groups is, per one benzene ring, preferably 2 or less, more preferably 1 or less, and most preferably 0, that is, all are a hydrogen atom.

(3)

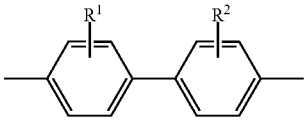

(4)

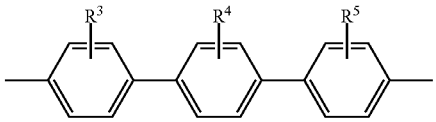

In formula (2), each of $Ar^4$ to $Ar^7$ independently represents an aryl group having a carbon number of 30 or less, which may have a substituent. The carbon number of the aryl group is 30 or less, preferably 20 or less, more preferably 15 or less. Specific examples thereof include a phenyl group, a naphthyl group, an anthranyl group and a pyrenyl group. In view of synthesis, a phenyl group or a naphthyl group is preferred; in view of crack resistance, a naphthyl group is most preferred; and in view of ease of production, a phenyl group is most preferred. The total carbon number of the substituents which may be substituted on $Ar^4$ to $Ar^7$ is 30 or less and in view of solubility and synthesis, preferably 20 or less, more preferably 10 or less. Specific examples of the substituent include an alkyl group, an alkoxy group, an amino group, and an aryl group. Among these, an alkyl group or an alkoxy group is preferred in view of low residual potential, and an alkyl group is preferred in view of responsivity. The carbon number of the alkyl group is 6 or less, preferably 4 or less, more preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group is most preferred. Also, the substituents may combine with each other to form a ring. For example, two alkyl groups may circularly combine to form a cycloalkyl group or may be ester-crosslinked to form a lactone or the like. The number of substituents is, per one aryl group, usually 3 or less, preferably 2 or less. The total number of substituents on $Ar^4$ to $Ar^7$ is usually 8 or less, preferably 6 or less, and is usually 0 or more, preferably 2 or more.

In the case where each of $Ar^4$ to $Ar^7$ is independently a phenyl group having a carbon number of 30 or less, which may have a substituent, the substitution position of the substituent which may be substituted on is preferably the ortho-position with respect to the nitrogen atom in view of light-induced fatigue, preferably the para-position in view of electrical characteristics, and preferably the meta position in view of solubility. Also, in view of crack resistance, each of $Ar^4$ and $Ar^6$ preferably has at least one substituent on the ortho-position or para-position with respect to the nitrogen atom.

The mixing ratio between the charge transport substance represented by formula (6) and the charge transport substance represented by formula (2) is usually from 20:80 to 95:5, preferably from 30:70 to 90:10, more preferably from 40:60 to 90:10. If the proportion of the charge transport substance represented by formula (6) is too large, the crack resistance may be deteriorated, whereas if the proportion of the charge transport substance represented by formula (2) is too large, the solubility may be deteriorated to cause precipitation of the substance in the photosensitive layer and this may affect the electrical characteristics, particularly, responsivity.

The total amount of the charge transport substance represented by formula (6) and the charge transport substance represented by formula (2) is, in terms of the weight per 100 parts by weight of the binder resin, in view of electrical characteristics, usually 40 parts by weight or more, preferably 60 parts by weight or more, more preferably 70 parts by weight or more, and in view of crack resistance and wear resistance, usually 150 parts by weight or less, preferably 120 parts by weight or less, more preferably 110 parts by weight or less.

Examples of the structures of the charge transport substances represented by formulae (6) and (2) suitable for the present invention are illustrated below. The following structures are examples for more specifically illustrating the present invention, and the present invention is not limited to these structures as long as the concept of the present invention is observed.

(1)-1

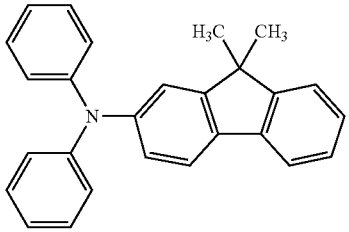

(1)-2

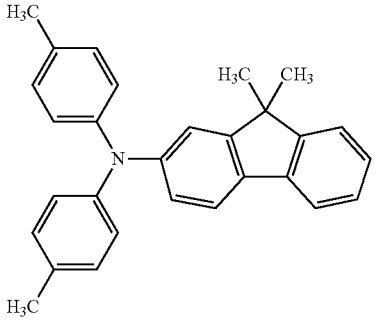

-continued
(1)-3
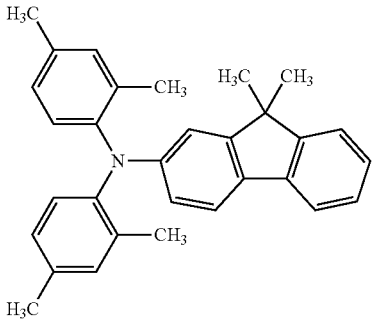
(1)-4
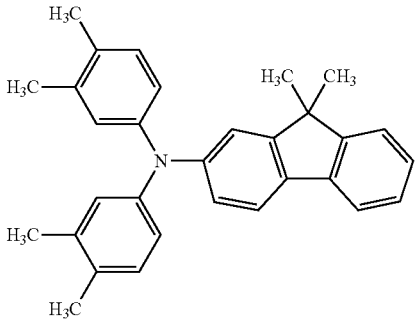
(1)-5
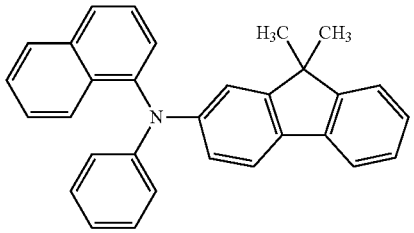
(1)-6
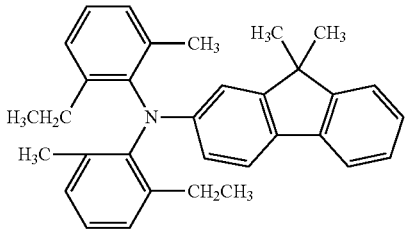
(1)-7
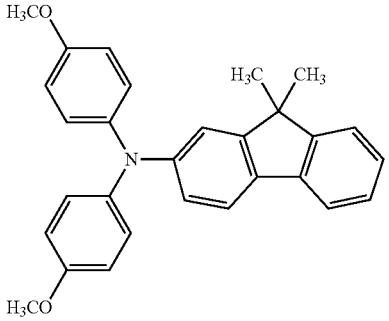
(1)-8
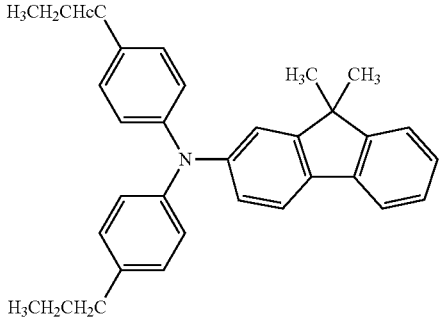
(1)-9
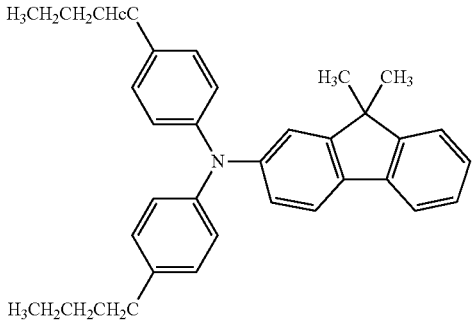
(1)-10
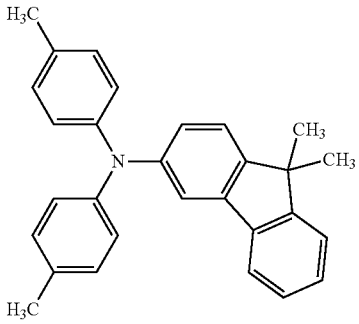
(1)-11
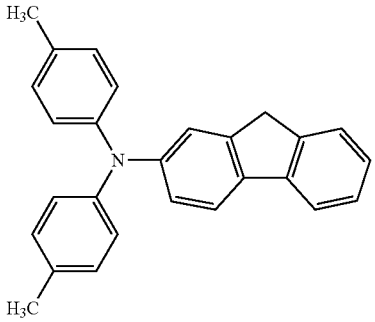
(1)-12
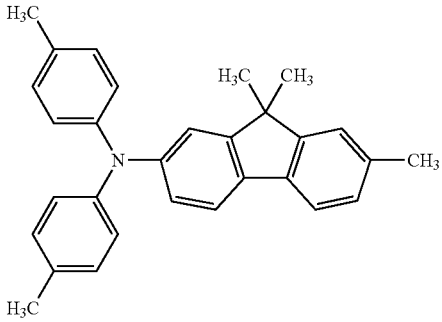

-continued
(2)-1
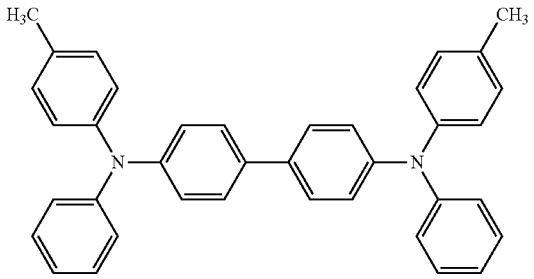
(2)-2
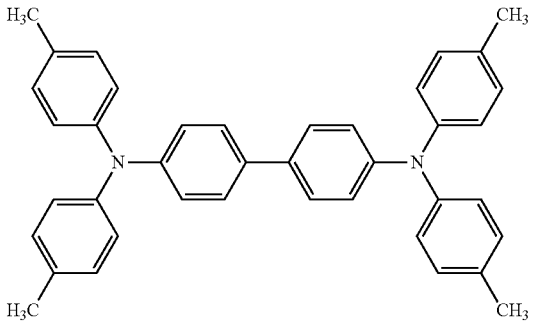
(2)-3
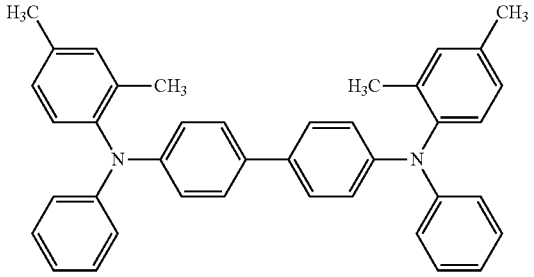
(2)-4
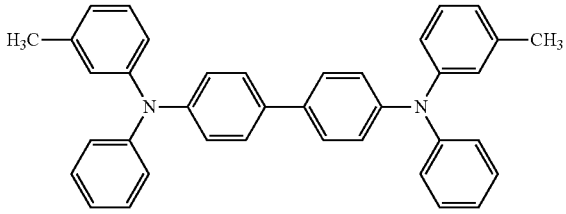
(2)-5
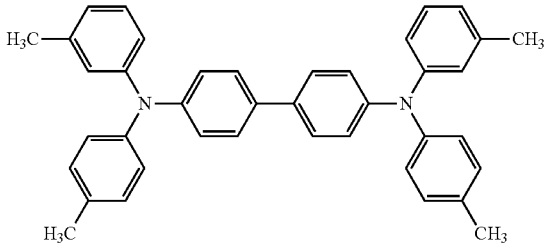
(2)-6
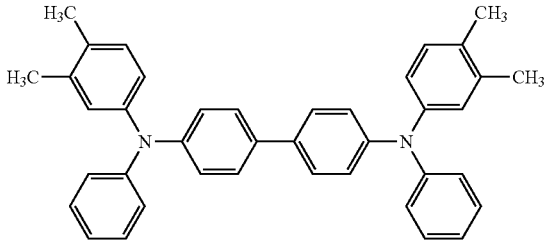
(2)-7
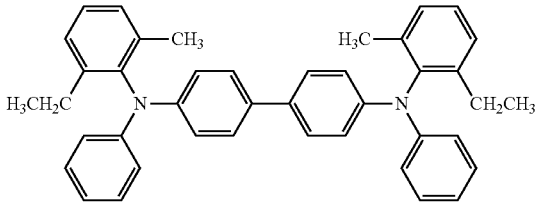
(2)-8
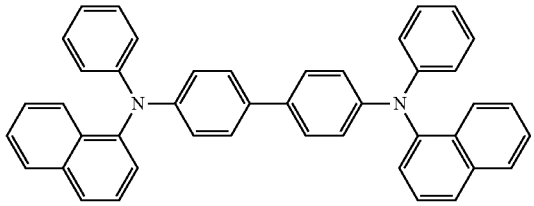
(2)-9
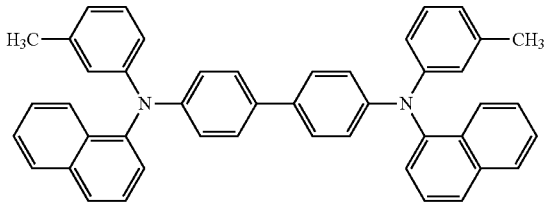
(2)-10
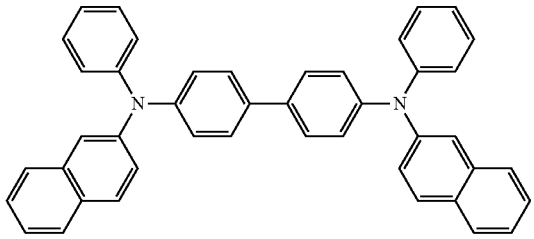

-continued
(2)-11
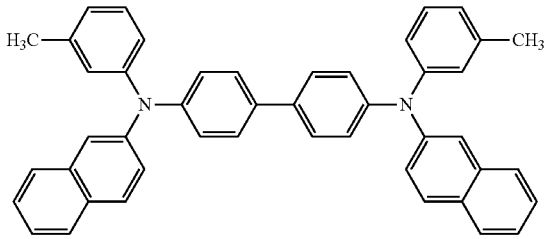
(2)-12
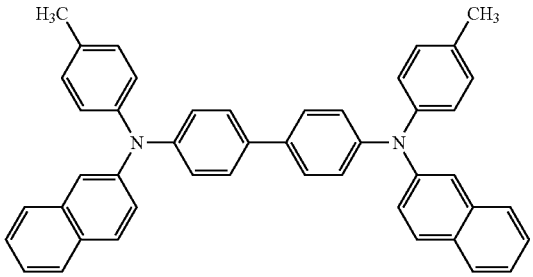
(2)-13
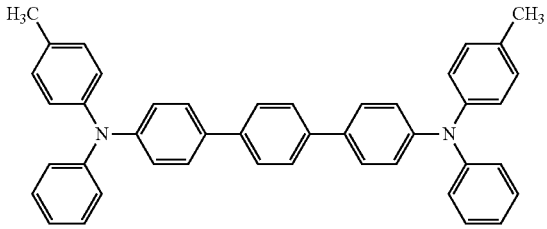
(2)-14
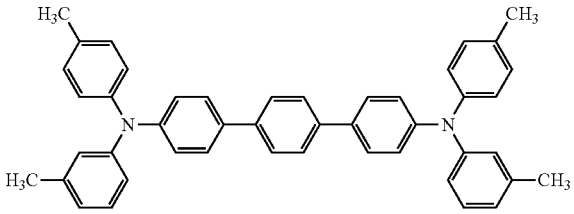
(2)-15
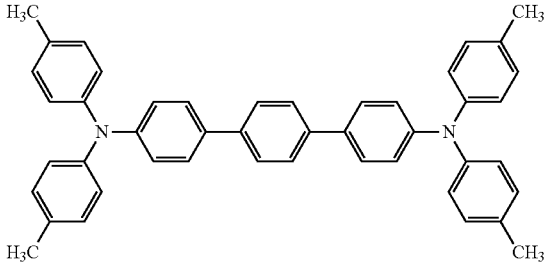
(2)-16
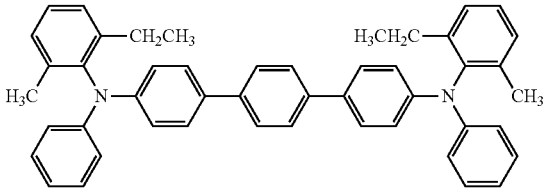
(2)-17
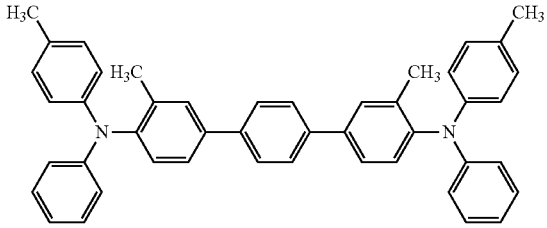
(2)-18
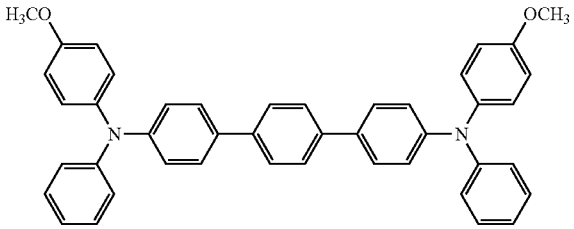
(2)-19
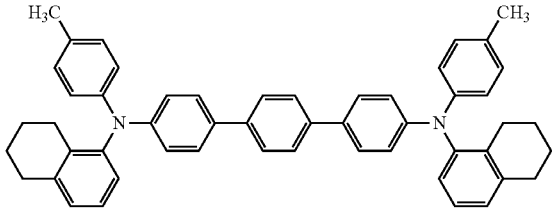
(2)-20
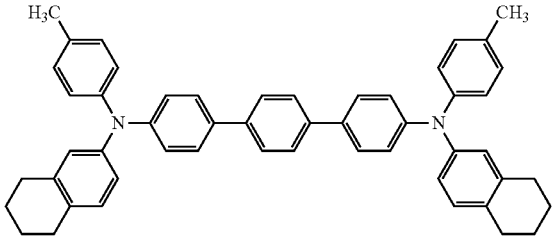

-continued (2)-21

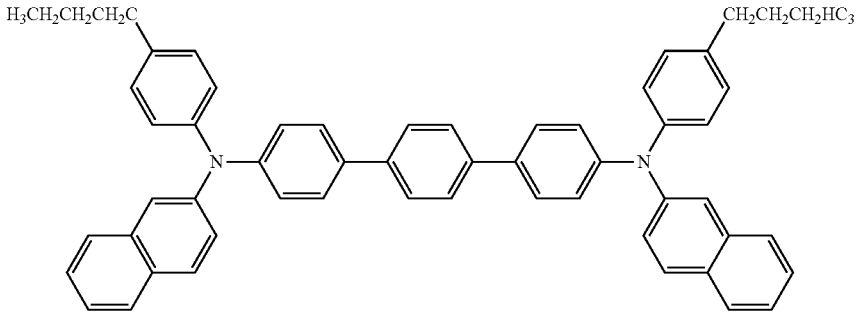

In addition to the charge transport substances represented by formulae (2) and (6), at least one of compounds represented by the following formulae (5a) to (5c) is used so as to improve the light-induced fatigue:

(5a)

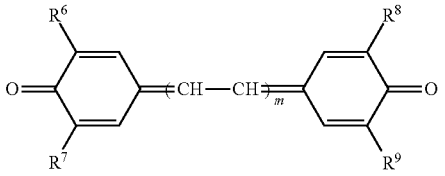

In formula (5a), each of $R^6$ to $R^9$ independently represents an alkyl group having a carbon number of 6 or less. The carbon number of $R^6$ to $R^9$ is 6 or less, preferably 4 or less. Examples of the alkyl group include a linear alkyl group such as methyl group, ethyl group and propyl group, and a branched alkyl group such as isopropyl group, tert-butyl group and tert-pentyl group. It is preferred that all of $R^6$ to $R^9$ are a tert-butyl group or in view of solubility, two members are a methyl group and two members are a tert-butyl group. m represents 0 or 1 and in view of ease of production, m is preferably 0.

(5b)

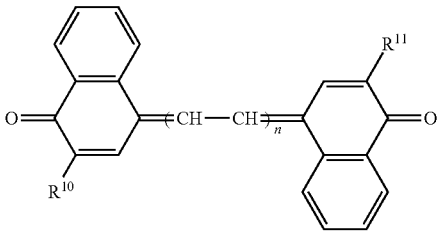

In formula (5b), each of $R^{10}$ and $R^{11}$ independently represents an alkyl group having a carbon number of 6 or less. The carbon number of $R^{10}$ and $R^{11}$ is 6 or less, preferably 4 or less. Examples of the alkyl group include a linear alkyl group such as methyl group, ethyl group and propyl group, and a branched alkyl group such as isopropyl group, tert-butyl group and tert-pentyl group. Among these, a branched alkyl group is preferred, and a tert-butyl group and a tert-pentyl group are more preferred. n represents 0 or 1 and in view of ease of production, n is preferably 0.

(5c)

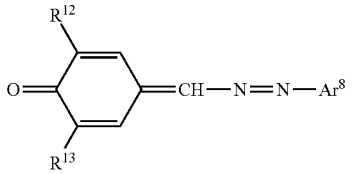

In formula (5c), each of $R^{12}$ and $R^{13}$ independently represents an alkyl group having a carbon number of 6 or less. The carbon number of $R^{12}$ and $R^{13}$ is 6 or less, preferably 4 or less. Examples of the alkyl group include a linear alkyl group such as methyl group, ethyl group and propyl group, and a branched alkyl group such as isopropyl group, tert-butyl group and tert-pentyl group. Among these, a branched alkyl group is preferred, and a tert-butyl group is more preferred. $Ar^8$ represents an aryl group having a carbon number of 30 or less, which may have a substituent. The carbon number of $Ar^8$ is 30 or less, preferably 20 or less, more preferably 15 or less. Specific examples thereof include a phenyl group, a naphthyl group, and an anthranyl group. Among these, a phenyl group is most preferred. Examples of the substituent which may be substituted on $Ar^8$ include an alkyl group, a nitro group and a halogeno group. Among these, a halogeno group is preferred, and a chloro group is more preferred.

The compound represented by formulae (5a) to (5c) is used in combination in the same layer as the charge transport substances represented by formulae (1) and (2), and if the amount added is too large, the compound may be precipitated to deteriorate the electrical characteristics. For this reason, the amount added of the compound is usually 50 parts by weight or less, preferably 20 parts by weight or less, more preferably 10 parts by weight or less, per 100 parts by weight of the binder resin. Also, if the amount of the compound added is too small, the effect of improving the light-induced fatigue may be reduced. Therefore, the amount added is usually 0.01 parts by weight or more, preferably 0.1 parts by weight or more, more preferably 0.5 parts by weight or more.

One of mechanisms whereby the compounds represented by formulae (5a) to (5c) contribute to improvement of light-induced fatigue is that the compounds represented by (5a) to (5c) have an appropriate light absorption region in the visible region because of containing a wide conjugated system and therefore, block external light. Furthermore, it is considered that the carbonyl group of a quinone skeleton or the like forms a weak charge transfer complex with the charge transport substances represented by formulae (1) and (2) and not only the light absorption region is more broadened but also the formed complex serves as an appropriate charge generating site upon exposure to intense light from outside and suppresses trapping of a hole, as a result, the potential in repeated use is stabilized. Incidentally, in the case of not adding the compounds represented by formulae (5a) to (5c), it is considered that out of triaryl amine units in the charge transport substances represented by formulae (1) and (2), two adjacent aryl groups cause a ring-closing reaction and an irreversible potential variation Occurs.

Preferred examples of the structural formulae of the compounds represented by formulae (5a) to (5c) are illustrated below.

(5)-1

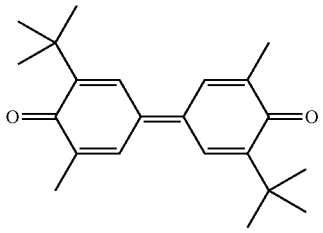

(5)-2

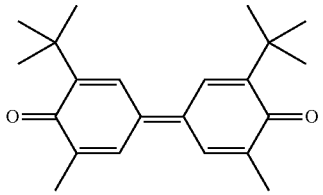

(5)-3

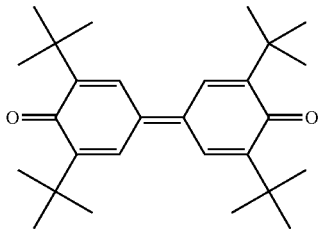

(5)-4

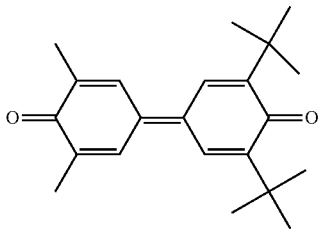

(5)-5

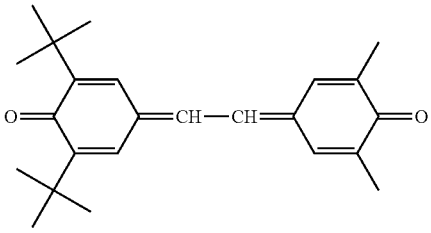

-continued (5)-6

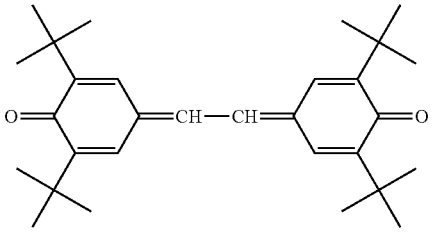

(5)-7

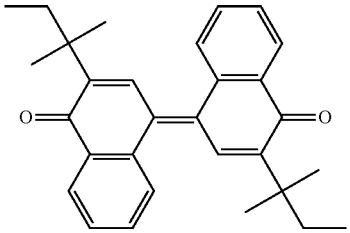

(5)-8

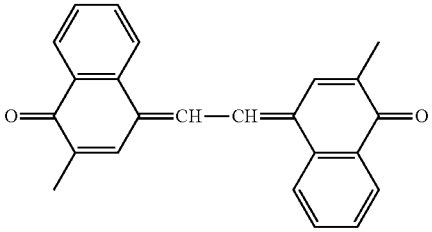

(5)-9

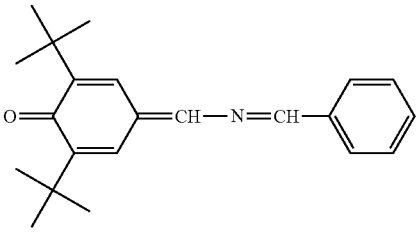

(5)-10

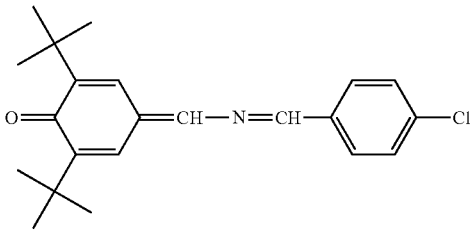

<<Electrophotographic Photoreceptor>>

The configuration of the electrophotographic photoreceptor of the present invention is described below. The electrophotographic photoreceptor of the present invention is a laminate-type photoreceptor used in a negative charge system, comprising a conductive support having thereon at least a charge generation layer and a charge transport layer in this order, wherein the charge transport substances represented by formulae (2) and (6) and at least one of compounds represented by formulae (5a) to (5c) are contained in the same charge transport layer. The charge transport layer contains a binder resin and, if desired, additionally contains an antioxidant, a leveling agent and other additives.

<Conductive Support>

The conductive support is not particularly limited, but examples of the support which is mainly used include a metal material such as aluminum, aluminum alloy, stainless steel, copper and nickel; a resin material in which an electrically conductive powder such as metal, carbon and tin oxide is added to impart electrical conductivity; and a resin, glass or paper, on which surface an electrically conductive material such as aluminum, nickel and ITO (indium tin oxide) is deposited or coated. One of these materials may be used alone, or two or more thereof may be used in combination by employing an arbitrary combination and an arbitrary ratio. As for the form of the conductive support, a support in the form of, for example, a drum, a sheet or a belt is used. Furthermore, an electroconductive support made of a metal material, on which an electrically conductive material having an appropriate resistance value is coated to control the electrical conductivity, surface property or the like or cover a defect, may be also used.

In the case where a metal material such as aluminum alloy is used as the conductive support, the metal material may be used after an anodic oxide film is applied thereto. When an anodic oxide film is applied, it is preferred to apply a sealing treatment by a known method.

The conductive support surface may be smooth or may be roughened by using a special cutting method or applying a polishing treatment. The roughening may be also achieved by mixing a particle having an appropriate particle diameter in the material constituting the conductive support. In addition, in order reduce the cost, it may be also possible to use a drawn pipe as it is without applying a cutting treatment.

<Undercoat Layer>

A undercoat layer may be provided between the conductive support and the later-described photosensitive layer so as to improve adhesive property, blocking property and the like. As the undercoat layer, for example, a resin or a resin having dispersed therein a particle such as metal oxide particle is used. The undercoat layer may be composed of a single layer or a plurality of layers.

Examples of the metal oxide particle used in the undercoat layer include a metal oxide particle containing one metal element, such as titanium oxide, aluminum oxide, silicon oxide, zirconium oxide, zinc oxide and iron oxide, and a metal oxide particle containing a plurality of metal elements, such as calcium titanate, strontium titanate and barium titanate. Of these metal oxide particles, one kind of a particle may be used alone, or a plurality of kinds of particles may be mixed and used. Among these metal oxide particles, titanium oxide and aluminum oxide are preferred, and titanium oxide is more preferred. The surface of the titanium oxide particle may be subjected to a treatment with an inorganic material such as tin oxide, aluminum oxide, antimony oxide, zirconium oxide and silicon oxide, or with an organic material such as stearic acid, polyol and silicone. As for the crystal form of the titanium oxide particle, any of rutile, anatase, brookite and amorphous may be used. Also, a plurality of crystal forms may be contained.

As for the particle diameter of the metal oxide particle, those having various particle diameters may be used but above all, in view of characteristics and liquid stability, the average primary particle diameter thereof is preferably from 10 to 100 nm, more preferably from 10 to 50 nm. This average primary particle diameter can be obtained using a TEM photograph or the like.

The undercoat layer is preferably formed in the form of a metal oxide particle being dispersed in a binder resin. The binder resin used in the undercoat layer includes an epoxy resin, a polyethylene resin, a polypropylene resin, an acrylic resin, a methacrylic resin, a polyamide resin, a vinyl chloride resin, a vinyl acetate resin, a phenol resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a polyurethane resin, a polyacrylic resin, a polyacrylamide resin, a polyvinylpyrrolidone resin, a polyvinylpyridine resin, a water-soluble polyester resin, a cellulose ester resin such as nitrocellulose, a cellulose ether resin, casein, gelatin, a polyglutamic acid, starch, a starch acetate, an amino starch, an organic zirconium compound such as zirconium chelate compound and zirconium alkoxide compound, an organic titanyl compound such as titanyl chelate compound and titanyl alkoxide compound, a silane coupling agent, and other known binder resins. One of these binder resins may be used alone, or two or more thereof may be used in combination by employing an arbitrary combination and an arbitrary ratio. The binder resin may be also used in the form of being hardened together with a hardening agent. Among others, for example, an alcohol-soluble copolymerized polyamide or modified polyamide is preferred because this binder resin exhibits good dispersibility and coatability.

The use ratio of the inorganic particle to the binder resin used in the undercoat layer may be arbitrarily selected, but in view of stability and coatability of the liquid dispersion, the inorganic particle is preferably used in a ratio of usually from 10 to 500 mass % based on the binder resin.

The film thickness of the undercoat layer may be arbitrary as long as the effects of the present invention are not seriously impaired, but from the standpoint of enhancing electrical characteristics, intense exposure characteristics, image characteristics and repetition characteristics of the electrophotographic photoreceptor as well as coatability at the production, the film thickness is usually 0.01 μm or more, preferably 0.1 μm or more, and usually 30 μm or less, preferably 20 μm or less. In the undercoat layer, a known antioxidant and the like may be mixed. Also, for example, a pigment particle or a resin particle may be incorporated into the undercoat layer for the purpose of preventing an image defect or the like.

<Photosensitive Layer>

The photosensitive layer is formed on the above-described conductive support (in the case of providing the undercoat layer, on the undercoat layer). The photosensitive layer is a layer containing the charge transport substances represented by formulae (2) and (6) and at least one of the compounds represented by formulae (5a) to (5c), and the mode thereof includes a function separation-type photosensitive layer having a laminate structure including two or more layers including a charge generation layer in which a charge generating substance is dispersed in a binder resin, and a charge transport layer in which a charge transport substance (including the charge transport substance of the present invention) is dispersed in a binder resin (hereinafter, sometimes referred to as "laminate-type photosensitive layer").

The laminate-type photosensitive layer includes a forward laminate-type photosensitive layer in which a charge generation layer and a charge transport layer are stacked in this order from the conductive support side, and a reverse laminate-type photosensitive layer in which conversely, a charge transport layer and a charge generation layer are stacked in this order from the conductive support side. Either type can be employed, but a forward laminate-type photosensitive layer capable of exerting best balanced photoconductivity is preferred.

<Laminate-Type Photosensitive Layer>

[Charge Generation Layer]

The charge generation layer of the laminate-type photosensitive layer (function separation-type photosensitive layer) contains a charge generating substance and at the same time, usually contains a binder resin and other components which are used, if desired. Such a charge generation layer can be obtained, for example, by dissolving or dispersing a charge generating substance and a binder resin in a solvent or a dispersion medium to produce a coating solution, and applying and drying the coating solution, in the case of a forward laminate-type photosensitive layer, on a conductive support (when providing a undercoat layer, on the undercoat layer), and in the case of a reverse laminate-type photosensitive layer, on a charge transport layer.

The charge generating substance includes an inorganic photoconductive material such as selenium, its alloys and cadmium sulfide, and an organic photoconductive material such as organic pigment, but an organic photoconductive material is preferred, and an organic pigment is more preferred. Examples of the organic pigment include a phthalocyanine pigment, an azo pigment, a dithioketopyrrolopyrrole pigment, a squalene (squarylium) pigment, a quinacridone pigment, an indigo pigment, a perylene pigment, a polycyclic quinone pigment, an anthanthrone pigment, and a benzimidazole pigment. Among these, a phthalocyanine pigment or an azo pigment is preferred. In the case of using an organic pigment as the charge generating substance, the organic pigment is usually used in the form of a disperse layer in which fine particles of the organic pigment are bound by a binder resin of various types.

In the case of using a phthalocyanine pigment as the charge generating substance, specific examples of the phthalocyanine pigment which is used include a metal-free phthalocyanine, phthalocyanines in each crystal form to which a metal such as copper, indium, gallium, tin, titanium, zinc, vanadium, silicon and germanium, or an oxide, halide, hydroxide, alkoxide or another form thereof is coordinated, and phthalocyanine dimers using an oxygen atom or the like as a crosslinking atom. In particular, an X-type or τ-type metal-free phthalocyanine as a highly sensitive crystal form, a titanyl phthalocyanine (another name: oxytitanium phthalocyanine) such as A-type (another name: β-type), B-type (another name: α-type) and D-type (another name: Y-type), a vanadyl phthalocyanine, a chloroindium phthalocyanine, a hydroxyindium phthalocyanine, a chlorogallium phthalocyanine such as II-type, a hydroxygallium phthalocyanine such as V-type, a μ-oxo-gallium phthalocyanine dimer such as G-type and I-type, and a μ-oxo-aluminum phthalocyanine dimer such as II-type, are suitable.

Among these phthalocyanines, a metal phthalocyanine is preferred; a titanyl phthalocyanine of A-type (another name: (β-type), B-type (another name: α-type) or D-type (Y-type) characterized in that the diffraction angle 2θ (±0.2° of the powder X-ray diffraction exhibits a clear peak at 27.1° or 27.3°, a II-type chlorogallium phthalocyanine, a V-type hydroxygallium phthalocyanine, a hydroxygallium phthalocyanine having a strongest peak at 28.1°, a hydroxygallium phthalocyanine characterized in that the diffraction angle has no peak at 26.2° but has a clear peak at 28.1° and the half-value width W of 25.9° is $0.1° \leq W \leq 0.4°$, a G-type μ-oxo-gallium phthalocyanine dimer and the like are more preferred; and out of gallium-based phthalocyanines, a II-type chlorogallium phthalocyanine, a V-type hydroxygallium phthalocyanine, a hydroxygallium phthalocyanine having a strongest peat at 28.1°, a hydroxygallium phthalocyanine characterized in that the diffraction angle has no peak at 26.2° but has a clear peak at 28.1° and the half-value width W of 25.9° is $0.1° \leq W \leq 4°$, a G-type μ-oxo-gallium phthalocyanine dimer and the like are most preferred.

In the case of using a metal-free phthalocyanine compound or a metal-containing phthalocyanine compound as the charge generating substance, a photoreceptor exhibiting high sensitivity to laser light having a relatively long wavelength, for example, laser light having a wavelength of about 780 nm, is obtained. In the case of using an azo pigment such as monoazo, diazo and trisazo, a photoreceptor exhibiting sufficient sensitivity to white light, laser light having a wavelength of about 660 nm, or laser light having a relatively short wavelength (for example, laser light having a wavelength of 380 to 500 nm) can be obtained.

As the phthalocyanine compound, a single compound may be used, or a mixture of some compounds or a compound in a mixed crystal state may be used. Here, as for the mixed state of phthalocyanine compounds or crystal forms, a mixed state formed by mixing respective constituent elements afterward may be used, or a mixed state may be formed in the production/processing step of a phthalocyanine compound, such as synthesis, pigmentation and crystallization. Known examples of the treatment therefor include an acid paste treatment, a grinding treatment, and a solvent treatment. The method for forming a mixed crystal state includes a method where, as described in JP-A-10-48859, two kinds of crystals are mixed, then mechanically ground and amorphorized and thereafter converted into a specific crystal state by a solvent treatment.

On the other hand, in the case of using an azo pigment as the charge generating substance, conventionally known various azo pigments can be used as long as the pigment has sensitivity to a light source for light input, but various bisazo pigments and trisazo pigments are suitably used.

In the case where the organic pigment exemplified above is used as the charge generating substance, one kind of an organic pigment may be used, or two or more kinds of pigments may be mixed and used. In this case, two or more kinds of charge generating substances having spectral sensitivity characteristics in different spectral regions of visible region and near infrared region are preferably used in combination, and it is more preferred to use a disazo pigment, a trisazo pigment and a phthalocyanine pigment in combination.

The binder resin used in the charge generation layer constituting the laminate-type photosensitive layer is not particularly limited, but examples thereof include an insulating resin, for example, a polyvinylacetal-based resin such as polyvinylbutyral resin, polyvinylformal resin and partially acetalized polyvinylbutyral resin in which butyral is partially modified with formal, acetal or the like, a polyarylate resin, a polycarbonate resin, a polyester resin, a modified ether-based polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinylpyridine resin, a cellulose-based resin, a polyurethane resin, an epoxy resin, a silicone resin, a polyvinyl alcohol resin, a polyvinylpyrrolidone resin, casein, a vinyl chloride-vinyl acetate-based copolymer such as vinyl chloride-vinyl acetate copolymer, hydroxy-modified vinyl chloride-vinyl acetate copolymer, carboxyl-modified vinyl chloride-vinyl acetate copolymer and vinyl chloride-vinyl acetate-maleic anhydride copolymer, a styrene-butadiene copolymer, a vinylidene chloride-acrylonitrile copolymer, a styrene-alkyd resin, a silicon-alkyd resin, and a phenol-formaldehyde resin; and an organic photoconductive polymer such as poly-N-vinylcarbazole, polyvinylanthracene and polyvinylperylene. Any one of these binder resins may be used alone, or two or more kinds thereof may be used as a mixture in arbitrary combination.

The charge generation layer is specifically formed by dispersing a charge generating substance in a solution resulting from dissolving the above-described binder resin in an organic solvent, to prepare a coating solution and applying the coating solution on a conductive support (in the case of providing a undercoat layer, on the undercoat layer).

The solvent used for the preparation of the coating solution is not particularly limited as long as it dissolves the binder resin, but examples thereof include a saturated aliphatic solvent such as pentane, hexane, octane and nonane, an aromatic solvent such as toluene, xylene and anisole, a halogenated aromatic solvent such as chlorobenzene, dichlorobenzene and chloronaphthalene, an amide-based solvent such as dimethylformamide and N-methyl-2-pyrrolidone, an alcohol-based solvent such as methanol, ethanol, isopropanol, n-butanol and benzyl alcohol, aliphatic polyhydric alcohols such as glycerin and polyethylene glycol, a chain or cyclic ketone-based solvent such as acetone, cyclohexanone, methyl ethyl ketone and 4-methoxy-4-methyl-2-pentanone, an ester-based solvent such as methyl formate, ethyl acetate and n-butyl acetate, a halogenated hydrocarbon-based solvent such as methylene chloride, chloroform and 1,2-dichloroethane, a chain or cyclic ether-based solvent such as diethyl ether, dimethoxyethane, tetrahydrofuran, 1,4-dioxane, methyl cellosolve and ethyl cellosolve, an aprotic polar solvent such as acetonitrile, dimethylsulfoxide, sulfolane and hexamethylphosphoric acid triamide, a nitrogen-containing compound such as n-butylamine, isopropanolamine, diethylamine, triethanolamine, ethylenediamine, triethylenediamine and triethylamine, a mineral oil such as ligroin, and water. Any one of these solvents may be used alone, or two or more thereof may be used in combination. Incidentally, in the case of providing the above-described undercoat layer, a solvent that does not dissolve the undercoat layer is preferred.

In the charge generation layer, as for the blending ratio (mass ratio) between the binder resin and the charge generating substance, the ratio of the charge generating substance is usually 10 parts by mass or more, preferably 30 parts by mass or more, and usually 1,000 parts by mass or less, preferably 500 parts by mass or less, per 100 parts by mass of the binder resin. The film thickness of the charge generation layer is usually 0.1 μm or more, preferably 0.15 μm or more, and usually 10 μm or less, preferably 0.6 μm or less. If the ratio of the charge generating substance is too high, the coating solution may be reduced in the stability due to aggregation or the like of the charge generating substance, whereas if the ratio of the charge generating substance is too low, this may incur reduction in the sensitivity as a photoreceptor.

As the method for dispersing the charge generating substance, a known dispersion method such as ball mill dispersion method, attritor dispersion method and sand mill dispersion method may be employed. At this time, it is effective to pulverize the particle to a particle size of 0.5 μm or less, preferably 0.3 μm or less, more preferably 0.15 μm or less.

<Charge Transport Layer>

The charge transport layer contains a charge transport substance, an additive, a binder resin, and other components that are used, if desired. Specifically, such a charge transport layer can be obtained by dissolving or dispersing a charge transport substance or the like and a binder resin in a solvent to prepare a coating solution, and applying and drying the coating solution on a charge generation layer. Incidentally, the charge transport layer may not only be a single layer but also have a configuration consisting of two or more layers. In the case of forming a charge transport layer with a multilayer configuration, the layer may be formed to have a gradient composition, for example, by increasing the proportion of the binder resin in a layer closer to the outermost surface. In this case, the charge transport substances represented by formula (6) and (2) and at least one of the compounds represented by formulae (5a) to (5c) are incorporated at the same time into at least one layer of the plurality of charge transport layers.

As the charge transport substance, in addition to the charge transport substances represented by formulae (6) and (2), other known charge transport substances may be used in combination. In the case of using another charge transport substance in combination, the kind thereof is not particularly limited, but, for example, a carbazole derivative, a hydrazone compound, a styryl derivative, an enamine derivative, a butadiene derivative, and a compound formed by combining a plurality of these derivatives are preferred.

In the photoreceptor of the present invention, a binder resin is used in the same layer as the charge transport substances (6) and (2) so as to secure the film strength. As the binder resin, a polymer or copolymer of a vinyl compound, such as butadiene resin, styrene resin, vinyl acetate resin, vinyl chloride resin, acrylic acid ester resin, methacrylic acid ester resin, vinyl alcohol resin and ethyl vinyl ether, a polyvinylbutyral resin, a polyvinylformal resin, a partially modified polyvinylacetal, a polyamide resin, a polyurethane resin, a cellulose ester resin, a phenoxy resin, a silicon resin, a silicon-alkyd resin, a poly-N-vinylcarbazole resin, a polycarbonate resin, and a polyester resin are suitably used. Among these, a polycarbonate resin and a polyester resin are preferred, and a polyester resin, particularly, a polyarylate resin that is a name for a full aromatic polyester resin, is most preferred because of its capability of making the elastic deformation rate high as well as in view of mechanical properties such as wear resistance, scratch resistance and filming resistance. In general, the polyester resin is superior to the polycarbonate resin in view of mechanical properties but is inferior to the polycarbonate resin in view of electrical characteristics and light-induced fatigue. This is considered to be attributable to the fact that the ester bond has higher polarity than the carbonate bond and at the same time, has strong acceptor property. In particular, with respect to the light-induced fatigue, the improvement effect by the addition of the compounds represented by formulae (5a) to (5c) to a polyester resin system is large.

The polyester resin is described below. In general, the polyester resin is obtained by condensation-polymerizing, as raw material monomers, a polyhydric alcohol component and a polyvalent carboxylic acid component such as carboxylic acid, carboxylic anhydride and carboxylic acid ester.

Examples of the polyhydric alcohol component include an alkylene (carbon number: from 2 to 3) oxide (average number of added moles: from 1 to 10) adduct of bisphenol A, such as polyoxypropylene (2.2)-2,2-bis(4-hydroxyphenyl)propane and polyoxyethylene (2.2)-2,2-bis(4-hydroxyphenyl)propane, ethylene glycol, propylene glycol, neopentyl glycol, glycerin, pentaerythritol, trimethylolpropane, hydrogenated bisphenol A, sorbitol, an alkylene (carbon number: from 2 to 3) oxide (average number of added moles: from 1 to 10) adduct thereof, and an aromatic bisphenol. A component containing one or more of these members is preferred.

Examples of the polyvalent carboxylic acid component include a dicarboxylic acid such as phthalic acid, isophthalic acid, terephthalic acid, fumaric acid and maleic acid, a succinic acid substituted with an alkyl group having a carbon number of 1 to 20 or an alkenyl group having a carbon number of 2 to 20, such as dodecylsuccinic acid and octylsuccinic acid, a trimellitic acid, a pyromellitic acid, an anhydride of such an acid, and an alkyl (carbon number: from 1 to 3) ester of such an acid. A component containing one or more of these members is preferred.

Among these polyester resins, preferred is a full aromatic polyester resin (polyarylate resin) having a structural unit represented by the following formula (7):

(7)

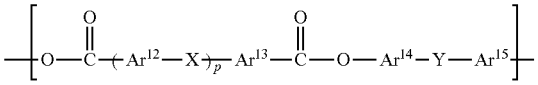

(in formula (7), each of $Ar^{12}$ to $Ar^{15}$ independently represents an arylene group which may have a substituent, X represents a single bond, an oxygen atom, a sulfur atom or an alkylene group, p represents an integer of 0 to 2, and Y represents a single bond, an oxygen atom, a sulfur atom or an alkylene group).

In formula (7), each of $Ar^{12}$ to $Ar^{15}$ independently represents an arylene group which may have a substituent. The carbon number of the arylene group is usually 6 or more, preferably 7 or more, and the upper limit thereof is usually 20 or less, preferably 10 or less, more preferably 8 or less. If the carbon number is too large, the production cost rises and the electrical characteristics may also deteriorate.

Specific examples of $Ar^{12}$ to $Ar^{15}$ include a 1,2-phenylene group, a 1,3-phenylene group, a 1,4-phenylene group, a naphthylene group, an anthrylene group, and a phenanthrylene group. Among others, the arylene group is preferably a 1,4-phenylene group in view of electrical characteristics. One kind of an arylene group may be used alone, or two or more kinds of arylene group may be used in an arbitrary ratio in any combination.

Specific examples of the substituent on $Ar^{12}$ to $Ar^{15}$ include an alkyl group, an aryl group, a halogen group, and an alkoxy group. Among others, considering the mechanical characteristics as the binder resin for the photosensitive layer and the solubility in a coating solution for photosensitive layer formation, the alkyl group is preferably a methyl group, an ethyl group, a propyl group or an isopropyl group, the aryl group is preferably a phenyl group or a naphthyl group, the halogen group is preferably a fluorine atom, a chlorine atom, a bromine atom or an iodine atom, and the alkoxy group is preferably a methoxy group, an ethoxy group, a propoxy group or a butoxy group. Incidentally, in the case where the substituent is an alkyl group, the carbon number of the alkyl group is usually 1 or more and is usually 10 or less, preferably 8 or less, more preferably 2 or less.

More specifically, each of $Ar^{14}$ and $Ar^{15}$ independently preferably has a number of substituents of 0 to 2 and in view of adhesive property, more preferably has a substituent. Above all, the number of substituents is preferably 1 in view of wear resistance, and the substituent is preferably an alkyl group, more preferably methyl group.

On the other hand, each of $Ar^{12}$ and $Ar^{13}$ independently preferably has a number of substituents of 0 to 2 and in view of wear resistance, more preferably has no substituent.

In formula (7), Y is a single bond, an oxygen atom, a sulfur atom or an alkylene group. The alkylene group is preferably —$CH_2$—, —$CH(CH_3)$—, —$C(CH_3)_2$— or cyclohexylene, more preferably —$CH_2$—, —$CH(CH_3)$—, —$C(CH_3)_2$— or cyclohexylene, still more preferably —$CH_2$— or —$CH(CH_3)$—.

In formula (7), X is a single bond, an oxygen atom, a sulfur atom or an alkylene group. Above all, X is preferably an oxygen atom. At this time, p is preferably 0 or 1 and most preferably 1.

Specific preferred examples of the dicarboxylic acid residue when p is 1 include a diphenylether-2,2'-dicarboxylic acid residue, a diphenylether-2,3'-dicarboxylic acid residue, a diphenylether-2,4'-dicarboxylic acid residue, a diphenylether-3,3'-dicarboxylic acid residue, a diphenylether-3,4'-dicarboxylic acid residue, and a diphenylether-4,4'-dicarboxylic acid residue. Among these, in view of simple and easy production of the dicarboxylic acid component, a diphenylether-2,2'-dicarboxylic acid residue, a diphenylether-2,4'-dicarboxylic acid residue and a diphenylether-4,4'-dicarboxylic acid residue are preferred, and a diphenylether-4,4'-dicarboxylic acid residue is more preferred.

Specific examples of the dicarboxylic acid residue when p is 0 include a phthalic acid residue, an isophthalic acid residue, a terephthalic acid residue, a toluene-2,5-dicarboxylic acid residue, a p-xylene-2,5-dicarboxylic acid residue, a naphthalene-1,4-dicarboxylic acid residue, a naphthalene-2,3-dicarboxylic acid residue, a naphthalene-2,6-dicarboxylic acid residue, a biphenyl-2,2'-dicarboxylic acid residue, and a biphenyl-4,4'-dicarboxylic acid residue. Among these, a phthalic acid residue, an isophthalic acid residue, a terephthalic acid residue, a naphthalene-1,4-dicarboxylic acid residue, a naphthalene-2,6-dicarboxylic acid residue, a biphenyl-2,2'-dicarboxylic acid residue and a biphenyl-4,4'-dicarboxylic acid residue are preferred, and an isophthalic acid residue and a terephthalic acid residue are more preferred. It is also possible to use a plurality of these dicarboxylic acid residues in combination. Specific preferred examples thereof include a polyarylate resin having a structural unit represented by the following formula (B-1) or (B-2). In formulae (B-1) and (B-2), the ratio between the isophthalic acid residue and the terephthalic acid residue is usually 50:50 but may be arbitrarily changed. In this case, the proportion of the terephthalic residue is preferably higher in view of electrical characteristics.

(B-1)

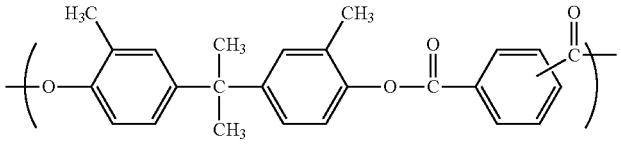

-continued (B-2)

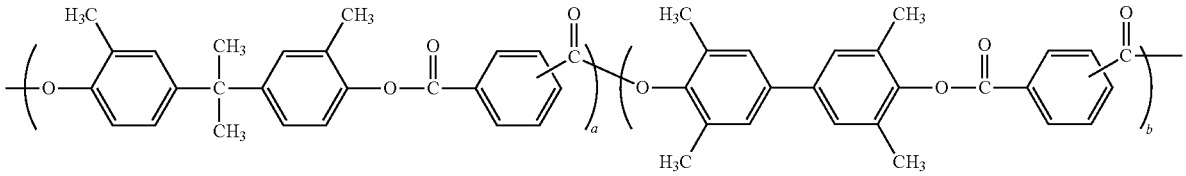

The polycarbonate resin is described below. In general, the polycarbonate resin is produced by a solvent method such as interfacial method (interfacial polycondensation method) and solution method, where bisphenols and phosgene are reacted in a solution, or a melting method of causing a polycondensation reaction between a bisphenol and a carbonic acid diester through a transesterification reaction, and these methods are widely used as an inexpensive production method. As for the bisphenols, the following compounds are suitably used. Incidentally, as the polycarbonate resin, not only a homopolymer composed of one kind of bisphenol but also a copolymer produced by copolymerizing two or more kinds of bisphenols are used.

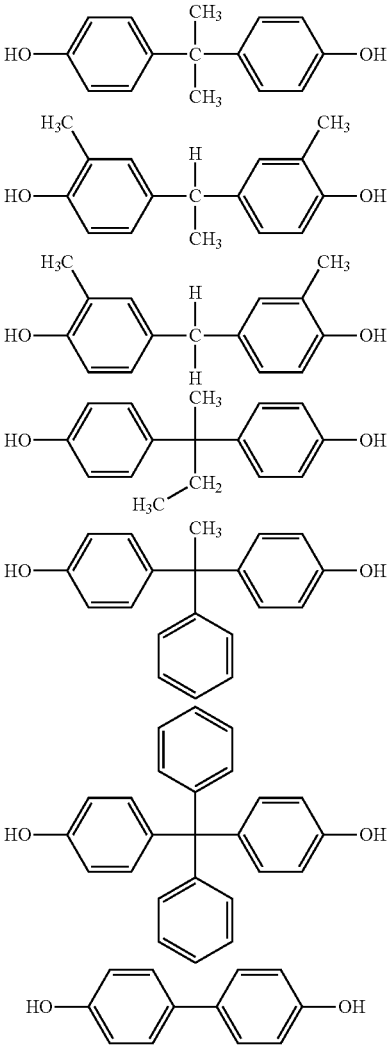

-continued

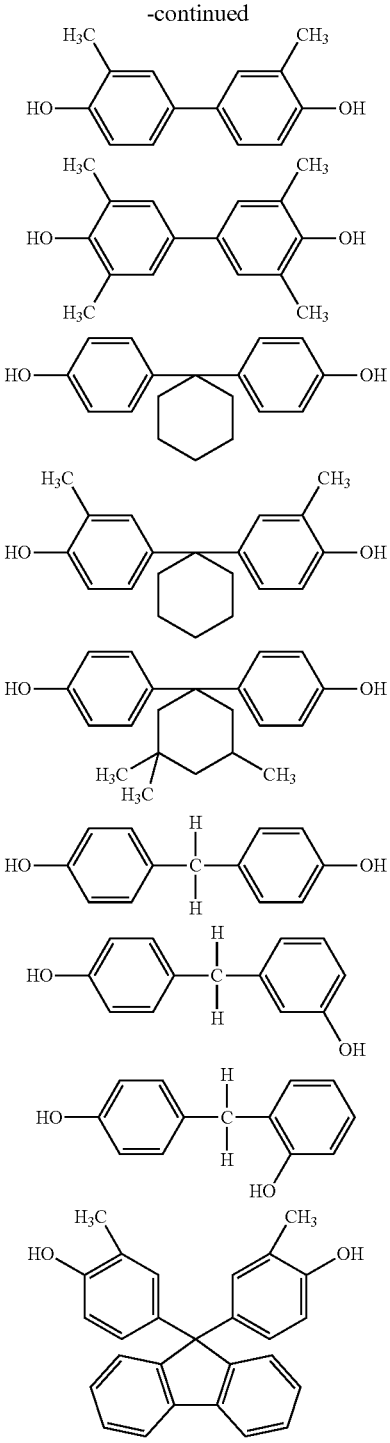

-continued

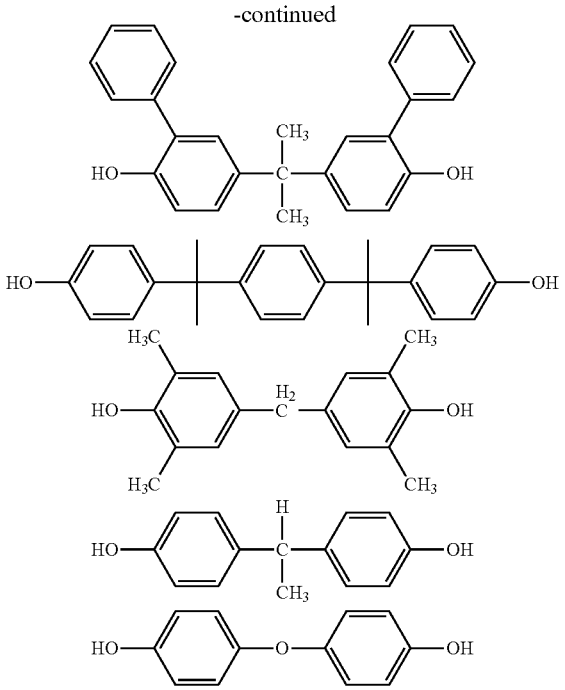

The binder resin for use in the present invention may have an arbitrary viscosity average molecular weight as long as the effects of the present invention are not seriously impaired, but the viscosity average molecular weight is preferably 10,000 or more, more preferably 20,000 or more, and the upper limit thereof is preferably 100,000 or less, more preferably 70,000 or less. If the viscosity average molecular weight is too small, the photoreceptor may lack the mechanical strength, whereas if the viscosity average molecular weight is too large, the viscosity of the coating solution for photosensitive layer formation is excessively large and the productivity may be reduced. Incidentally, the viscosity average molecular weight can be measured, for example, using an Ubbelohde capillary viscometer or the like by the method described in Examples.

In addition to the above-described polyester resin and polycarbonate resin, other binder resins may be mixed and used as long as the effects of the present invention are not impaired. Examples of the binder resin which may be mixed and used include a butadiene resin, a styrene resin, a vinyl acetate resin, a vinyl chloride resin, an acrylic acid ester resin, a methacrylic acid ester resin, a vinyl alcohol resin, a polymer or copolymer of a vinyl compound such as ethyl vinyl ether, a polyvinylbutyral resin, a polyvinylformal resin, a partially modified polyvinyl acetal, a polyamide resin, a polyurethane resin, a cellulose ester resin, a phenoxy resin, a silicon resin, a silicon-alkyd resin, and a poly-N-vinylcarbazole resin.

The film thickness of the charge transport layer is not particularly limited, but in view of long life and image stability as well as charging stability, the film thickness is usually 5 μm or more, preferably 10 μm or more, and is usually 50 μm or less, preferably 45 μm or less, more preferably 30 μm or less, and from the standpoint of achieving high resolution, most preferably 25 μm or less.

<Other Additives>

In both the laminate-type photoreceptor and the single layer-type photoreceptor, for the purpose of enhancing the deposition property, flexibility, coatability, contamination resistance, gas resistance, light resistance and the like, known additives such as antioxidant, plasticizer, ultraviolet absorber, electron-withdrawing compound, leveling agent and visible light-shielding agent may be incorporated into the photosensitive layer or each layer constituting the photosensitive layer.

<Other Functional Layers>

Also, in both the laminate-type photoreceptor and the single layer-type photoreceptor, the photosensitive layer formed by the above-described procedure may be caused to serve as the uppermost layer, that is, the surface layer, but another layer may be further provided thereon to serve as the surface layer. For example, a protective layer may be provided for the purposes of protecting the photosensitive layer against wear damage or preventing or keeping the photosensitive layer from deterioration due to a discharge product or the like generated, for example, from a charging device.

The electrical resistance of the protective layer is usually from $10^9$ to $10^{14}$ Ω·cm. If the electrical resistance exceeds this range, the residual potential rises to cause a lot of fogging on the image, whereas if the electrical resistance is less than the range above, blurring of the image and reduction in the resolution may be brought about. In addition, the protective layer must be configured not to substantially inhibit passing of irradiation light during imagewise exposure.

For the purpose of, for example, reducing the friction resistance or abrasion on the photoreceptor surface or increasing the transfer efficiency of toner from the photoreceptor to a transfer belt and paper, a fluorine-based resin, a silicon resin, a polyethylene resin or the like, a particle made of such a resin, or an inorganic compound particle may be incorporated into the surface layer. Alternatively, a layer containing such a resin or particle may be newly formed as the surface layer.

<Method for Forming Each Layer>

A coating solution obtained by dissolving or dispersing the substances to be incorporated into the layer in a solvent is coated on a conductive support by a known method such as such as dip coating, spray coating, nozzle coating, bar coating, roll coating and blade coating and dried, and this process is repeated for every sequential layer, whereby the above-described layers constituting the photoreceptor are formed.

The solvent or dispersion medium used for the preparation of the coating solution is not particularly limited, but specific examples thereof include alcohols such as methanol, ethanol, propanol and 2-methoxyethanol, ethers such as tetrahydrofuran, 1,4-dioxane and dimethoxyethane, esters such as methyl formate and ethyl acetate, ketones such as acetone, methyl ethyl ketone, cyclohexanone and 4-methoxy-4-methyl-2-pentanone, aromatic hydrocarbons such as benzene, toluene and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane and trichloroethylene, nitrogen-containing compounds such as n-butylamine, isopropanolamine, diethylamine, triethanolamine, ethylenediamine and triethylenediamine, and aprotic polar solvents such as acetonitrile, N-methylpyrrolidone, N,N-dimethylformamide and dimethylsulfoxide. One of these solvents may be used alone, or any two or more kinds thereof may be used in combination by employing an arbitrary combination.

The amount of the solvent or dispersion medium used is not particularly limited but is preferably adjusted such that the physical properties of the coating solution, such as solid content concentration and viscosity, fall in desired ranges by taking into consideration the intended use of each layer and the property of the solvent or dispersion medium.

For example, in the case of a single layer-type photoreceptor and the charge transport layer of a laminate-type photoreceptor, the solid content concentration of the coating solution is usually 5 mass % or more, preferably 10 mass % or more, and usually 40 mass % or less, preferably 35 mass % or less. Also, the viscosity of the coating solution at the in-use temperature is usually 10 mPa·s or more, preferably 50 mPa·s or more, and usually 500 mPa·s or less, preferably 400 mPa·s or less.

In the case of the charge generation layer of a laminate-type photoreceptor, the solid content concentration of the coating solution is usually 0.1 mass % or more, preferably 1 mass % or more, and usually 15 mass % or less, preferably 10 mass % or less. Also, the viscosity of the coating solution at the in-use temperature is usually 0.01 mPa·s or more, preferably 0.1 mPa·s or more, and usually 20 mPa·s or less, preferably 10 mPa·s or less.

Examples of the method for applying the coating solution include a dip coating method, a spray coating method, a spinner coating method, a bead coating method, a wire bar coating method, a blade coating method, a roller coating method, an air knife coating method, and a curtain coating method, but other known coating methods may be also used.

As for drying, the coating solution is preferably dried to touch at room temperature and then heat-dried at a temperature of usually from 30 to 200° C. for 1 minute to 2 hours statically or by blowing air. Also, the heating temperature may be constant or the heating may be performed while changing the temperature during drying.

<<Image Forming Apparatus>>

An embodiment of the image forming apparatus (image forming apparatus of the present invention) using the electrophotographic photoreceptor of the present invention is described below by referring to FIG. 1 which illustrates the configuration of main parts of the apparatus. However, the embodiment is not limited to the following description, and the present invention can be performed by arbitrarily making modifications therein without departing from the purport of the present invention.

As shown in FIG. 1, the image forming apparatus is configured to include an electrophotographic photoreceptor 1, a charging device 2, an exposure device 3, and a developing device 4, and furthermore, a transfer device 5, a cleaning device 6 and a fixing device 7 are provided, if desired.

The electrophotographic photoreceptor 1 is not particularly limited as long as it is the above-described electrophotographic photoreceptor of the present invention, but FIG. 1 shows, as an example thereof, a drum-shaped photoreceptor in which the photosensitive layer described above is formed on the surface of a cylindrical conductive support. Along the outer peripheral surface of the electrophotographic photoreceptor 1, the charging device 2, the exposure device 3, the developing device 4, the transfer device 5, and the cleaning device 6 are disposed.

The charging device 2 serves to charge the electrophotographic photoreceptor 1 and evenly charges the surface of the electrophotographic photoreceptor 1 to a given potential. Examples of the charging device which is often used include a corona charging device such as corotron and scorotron, and a direct charging device (contact-type charging device) in which a voltage-applied direct charging member is put into contact with the surface of the photoreceptor for charging. Examples of the direct charging device include a charging roller and a charging brush. Incidentally, in FIG. 1, a roller-type charging device (charging roller) is shown as one example of the charging device 2. As the direct charging method, both of charging involving atmospheric discharge and injection charging involving no atmospheric discharge can be used. The voltage applied at the charging may be a direct current voltage alone, or a direct current voltage may be used by superposing an alternate current voltage thereon.

The exposure device 3 is not particularly limited in its kind as long as it can expose the electrophotographic photoreceptor 1 and form an electrostatic latent image on the photosensitive surface of the electrophotographic photoreceptor 1. Specific examples thereof include a halogen lamp, a fluorescent lamp, a laser such as semiconductor laser and He—Ne laser, and LED. Also, the exposure may be performed by a photoreceptor internal exposure system. The light at the exposure is arbitrary, but the exposure may be performed, for example, to monochromatic light at a wavelength of 780 nm, monochromatic light slightly on the short wavelength side at a wavelength of 600 to 700 nm, or monochromatic light having a short wavelength at a wavelength of 380 to 500 nm.

The developing device 4 is not particularly limited in its kind, and an arbitrary device, for example, a dry development system such as cascade development, one-component insulating toner development, one-component conductive toner development and two-component magnetic brush development, or a wet development system, can be used. In FIG. 1, the developing device 4 includes a development tank 41, an agitator 42, a feed roller 43, a developing roller 44 and a regulating member 45 and is configured to store a toner T inside the development tank 41. If desired, a replenisher device (not shown) for replenishing the toner T may be attached to the developing device 4. The replenisher device is configured to enable replenishment of the toner T from a container such as bottle and cartridge.

The feed roller 43 is formed of an electrically conductive sponge or the like. The developing roller 44 is, for example, a roller made of a metal such as iron, stainless steel, aluminum and nickel, or a resin roller obtained by coating such a metal roller with a silicon resin, a urethane resin, a fluororesin or the like. If desired, the surface of the developing roller 44 may be subjected to smoothing or roughening processing.

The developing roller 44 is disposed between the electrophotographic photoreceptor 1 and the feed roller 43 and is abutted with each of the electrophotographic photoreceptor 1 and the feed roller 43. The feed roller 43 and the developing roller 44 are rotated each by a rotation driving mechanism (not shown). The feed roller 43 carries the stored toner T and feeds it to the developing roller 44. The developing roller 44 carries the toner T fed by the feed roller 43 and brings it into contact with the surface of the electrophotographic photoreceptor 1.

The regulating member 45 is formed by a resin blade made of a silicone resin, a urethane resin or the like, a metal blade made of stainless steel, aluminum, copper, brass, phosphor bronze or the like, or a blade produced by coating such a metal blade with a resin. The regulating member 45 is abutted with the developing roller 44 and is pushed toward the developing roller 44 by a spring or the like under a predetermined pressure (the blade linear pressure is generally from 5 to 500 g/cm). If desired, the regulating member 45 may be designed to have a function of charging the toner T by frictional charging with the toner T.

The agitator 42 is rotated by a rotation driving mechanism and while agitating the toner T, conveys the toner T toward the feed roller 43 side. A plurality of agitators 42 differing in the blade shape, the size or the like may be provided.

The toner T may be of its type and in addition to a powder toner, for example, a polymerized toner produced using a suspension polymerization method, an emulsification polymerization method or the like may be used. Above all, in the case of using a polymerized toner, a small-diameter toner having a particle diameter of approximately from 4 to 8 μm is preferred. As for the shape of the toner particle, various toner particles from a substantially spherical shape to a potato shape deviating from a sphere can be used. The polymerized toner is excellent in charging uniformity and transfer property and is suitably used for achieving a high image quality.

The transfer device 5 is not particularly limited in its kind, and a device employing an arbitrary system, for example, an electrostatic transfer method, a pressure transfer method or an adhesive transfer method, such as corona transfer, roller transfer and belt transfer, may be used. Here, the transfer device 5 shall include a transfer charger, a transfer roller, a transfer belt and the like all disposed to face the electrophotographic photoreceptor 1. The transfer device 5 is applied with a predetermined voltage value (transfer voltage) having a polarity opposite the charge potential of the toner T and transfers the toner image formed on the electrophotographic photoreceptor 1 onto recording paper (paper, medium) P.

The cleaning device 6 is not particularly limited, and an arbitrary cleaning device such as brush cleaner, magnetic brush cleaner, electrostatic brush cleaner, magnetic roller cleaner and blade cleaner may be used. The cleaning device 6 scrapes away the residual toner adhering to the photoreceptor 1 by a cleaning member to collect the residual toner. In case where no or little toner remains on the photoreceptor surface, the cleaning device 6 may be omitted.

The fixing device 7 is composed of an upper fixing member (fixing roller) 71 and a lower fixing member (fixing roller) 72, and a heating device 73 is provided inside the fixing member 71 or 72. Incidentally, FIG. 1 shows an example where a heating device 73 is provided inside the upper fixing member 71. For each of the upper and lower fixing members 71 and 72, a known heat-fixing member, for example, a fixing roller obtained by coating an original metal pipe made of stainless steel, aluminum or the like with silicone rubber, a fixing roller further coated with Teflon resin, or a fixing sheet, can be used. Furthermore, the fixing members 71 and 72 may be configured to supply a release agent such as silicone oil for enhancing the releasability or may be configured to forcedly apply a pressure by a spring or the like.

The toner transferred onto the recording paper P is thermally heated up to a state of the toner melted in the course of passing between the upper fixing member 71 and the lower fixing member 72 each heated at a predetermined temperature and after passing therebetween, the toner is cooled and fixed on the recording paper P.

Here, the fixing device is also not particularly limited in its kind, and as well as the fixing device used above, a fixing device employing an arbitrary system such as heat roller fixing, flash fixing, oven fixing and pressure fixing can be provided.

In the thus-configured electrophotographic apparatus, image recording is performed as follows. That is, first, the surface (photosensitive surface) of the photoreceptor 1 is charged to a predetermined potential (for example, −600 V) by the charging device 2. At this time, the surface may be charged by a direct current voltage or may be charged by superposing an alternate current voltage on a direct current voltage.

Subsequently, the photosensitive surface of the charged photoreceptor 1 is exposed by the exposure device 3 according to the image to be recorded, thereby forming an electrostatic latent image on the photosensitive surface. The electrostatic latent image formed on the photosensitive surface of the photoreceptor 1 is then developed by the developing device 4.

In the developing device 4, the toner T fed by the feed roller 43 is regulated to a thin layer by the regulating member (developing blade) 45, frictionally charged to a predetermined polarity (here, the same polarity as the charging potential of the photoreceptor 1, that is, negative polarity), conveyed on the developing roller 44, and brought into contact with the surface of the photoreceptor 1.

When the electrically charged toner T carried on the developing roller 44 comes into contact with the photoreceptor 1 surface, a toner image corresponding to the electrostatic latent image is formed on the photosensitive surface of the photoreceptor 1. This toner image is then transferred onto the recording paper P by the transfer device 5. Thereafter, the toner not transferred but remaining on the photosensitive surface of the photoreceptor 1 is removed by the cleaning device 6.

After transferring the toner image onto the recording paper P, the paper is passed through the fixing device 7 to heat-fix the toner image on the recording paper P, whereby a final image is obtained.

Incidentally, in addition to the above-described configuration, the image forming apparatus may have a configuration where, for example, a charge erasing step can be performed. The charge erasing step is a step of exposing the electrophotographic photoreceptor and thereby erasing the charge of the electrophotographic photoreceptor. As for the charge erasing device, a fluorescent lamp, LED or the like is used. Also, the light used in the charge erasing step is, in many cases, light having an intensity of, in terms of the exposure energy, 3 times or more that of the exposure light.

The image forming apparatus may also have a modified configuration, for example, may be configured to allow for steps such as pre-exposure step and auxiliary charging step, may be configured to perform offset printing, or may be configured in a full-color tandem system using a plurality of kinds of toners.

Here, the photoreceptor 1 may be configured as an integrated cartridge (hereinafter, sometimes referred to as "electrophotographic photoreceptor cartridge") by combining one member or two or more members out of the charging device 2, the exposure device 3, the developing device 4, the transfer device 5, the cleaning device 6 and the fixing device 7, and the electrophotographic photoreceptor cartridge may be configured to be removable from the main body of the electrophotographic apparatus such as copying machine and laser beam printer. In this case, for example, when the electrophotographic photoreceptor 1 or other members are deteriorated, the electrophotographic photoreceptor cartridge is removed from the main body of the image forming apparatus, and another new electrophotographic photoreceptor cartridge is attached to the main body of the image forming device, whereby the maintenance/management of the image forming device is facilitated.

EXAMPLES

The embodiment of the present invention is described in greater detail below by referring to Examples. However, the following Examples are given for explaining the present invention in detail, and the present invention is not limited to these Examples and can be performed by arbitrarily making modifications therein without departing from the purport of the present invention. In the following Examples and Comparative Examples, unless otherwise indicated, the "parts" indicates "parts by weight" or "parts by mass".

Example 1

Production of Coating Solution for Undercoat layer Formation

Rutile titanium oxide having an average primary particle diameter of 40 nm ("TTO55N", produced by Ishihara Sangyo Kaisha, Ltd.) and methyldimethoxysilane ("TSL8117", produced by Toshiba Silicones) in an amount of 3 mass % based on the titanium oxide were mixed in a Henschel mixer, and the obtained surface-treated titanium oxide was dispersed in a mixed solvent of methanol/1-propanol at a mass ratio of 7/3 by a ball mill to make a dispersion slurry of surface-treated titanium oxide. This dispersion slurry, a mixed solvent of methanol/1-propanol/toluene, and a pellet of a copolymerized polyamide composed of ϵ-caprolactam [the compound represented by the following formula (A)]/bis(4-amino-3-methylcyclohexyl)methane [the compound represented by the following formula (B)]/hexamethylenediamine [the compound represented by the following formula (C)]/decamethylenedicarboxylic acid [the compound represented by the following formula (D)]/octadecamethylenedicarboxylic acid [the compound represented by the following formula (E)] in a compositional molar ratio of 60%/15%/5%/15%/5% were stirred and mixed under heating to dissolve the polyamide pellet, and the obtained solution was subjected to an ultrasonic dispersion treatment to produce a coating solution for undercoat layer formation containing surface-treated titanium oxide/copolymerized polyamide in a weight ratio of 3/1 and having a solid content concentration of 18.0%, in which the weight ratio of methanol/1-propanol/toluene was 7/1/2.

A

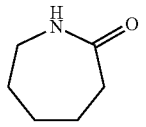

B

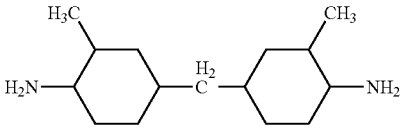

C

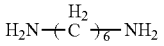

D

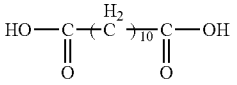

E

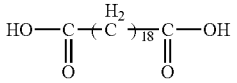

<Production of Coating Solution for Charge Generation Layer Formation>

20 Parts of Y-type (another name: D-type) oxytitanium phthalocyanine exhibiting a strong diffraction peak at a Bragg angle (2θ±0.2) of 27.3° in X-ray diffraction by CuKα ray was mixed as a charge generating substance with 280 parts of 1,2-dimethoxyethane, and the mixture was ground in a sand grinding mill for 1 hour to perform a pulverization/dispersion treatment. This pulverization-treated solution was mixed with a binder solution obtained by dissolving 10 parts of polyvinylbutyral ("Denka Butyral" #6000C, trade name, produced by Denki Kagaku Kogyo K.K.) in a mixed solution of 255 parts of 1,2-dimethoxyethane and 85 parts of 4-methoxy-4-methyl-2-pentanone and with 230 parts of 1,2-dimethoxyethane to prepare a coating solution for charge generation layer formation.

<Production of Coating Solution for Charge Transport Layer Formation>

100 Parts of polyarylate resin (B-1) having the following repeating structural unit (viscosity average molecular weight: 35,000, terephthalic acid: isophthalic acid=50:50); 40 parts of Compound (1)-2, 40 parts of Compound (2)-4, and 2 parts of a mixture of formulae (5)-1 and (5)-2 (weight ratio: 75:25), as charge transport substances; and 0.05 parts of silicone oil (KF96, trade name, produced by Shin-Etsu Silicone), were dissolved in 600 parts of a mixed solvent of tetrahydrofuran (hereinafter, sometimes simply referred to as THF)/toluene (8/2 (by weight)) to prepare a coating solution for charge transport layer formation.

(B-1)

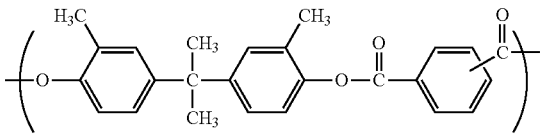

<Production of Photoreceptor>

On a polyethylene terephthalate sheet having deposited on the surface thereof aluminum, the coating solution for undercoat layer formation obtained above was coated by a wire bar to have a film thickness of about 1.3 μm after drying and dried at room temperature to provide a undercoat layer.

On this undercoat layer, the coating solution for charge generation layer formation obtained above was coated by a wire bar to have a film thickness of about 0.3 μm after drying and dried at room temperature to provide a charge generation layer.

On this charge generation layer, the coating solution for charge transport layer formation obtained above was coated by an applicator to have a film thickness of about 25 μm after drying and dried at 125° C. for 20 minutes to produce a photoreceptor.

<Electrical Characteristic Test>

Using an apparatus for evaluating electrophotographic characteristics manufactured in accordance with the measurement standards by the Society of Electrophotography of Japan (described in Zoku Denshi Shashin Gijutsu no Kiso to Oyo (Basic and Application of Electrophotographic Technology, Part II), compiled by the Society of Electrophotography of Japan, Corona Publishing Co., Ltd., pp. 404-405), the sheet-like photoreceptor obtained above was wound around an aluminum-made cylinder having a diameter of 80 mm and after attaching a grounding wire, charged to give an initial surface potential of −700 V, and the surface potential (light potential; referred to as VL) when exposed to 780-nm monochromatic light at 0.4 μJ/cm$^2$ into which light of a halogen lamp was converted through an interference filter, was determined. The time from exposure to potential measurement was set to 60 ms. For the erasing light, LED light of 660 nm was used. The measurement was performed in an environment of 25° C. and 50% RH. A smaller absolute value of VL indicates better electrical characteristics. The results are shown in Table 1.

<Light-Induced Fatigue Test>

The photoreceptor above was irradiated for 10 minutes with light from a white fluorescent lamp (NEOLUMISUPER FL 20SS·W/18, manufactured by Mitsubishi Osram Corp.) adjusted to give a light intensity of 2,000 lux on the photoreceptor surface and after standing in a dark place for 10 minutes, the same measurement as in <Electrical Characteristic Test> above was performed. With respect to halftone potentials (the potential attenuated to almost about half of the surface potential) VH and VL of the photoreceptor, the changes ΔVH and ΔVL1 in the electrical characteristics between before and after irradiation with white fluorescent light are shown in Table 1. Also, the variation value ΔVL2 (the amount of variation from the VL value before irradiation with white fluorescent light) of VL after standing overnight and the variation value ΔVL3 (the amount of variation from the VL value after standing overnight) of VL between before and after further repeating a charging-exposure-erasing process 5,000 times were determined. In Table 1, the negative numerical value indicates that the absolute value of the potential after light irradiation became smaller than the absolute value of potential before light irradiation, and the positive numerical value indicates that conversely, the absolute value became larger. As the absolute values of these changes ΔVH, ΔVL1, ΔVL2 and ΔVL3 are smaller, the light-induced fatigue is less likely to occur, which is preferred.

Examples 2 to 4

Photoreceptors were produced and evaluated in the same manner as in Example-1 except for changing the mixture of (5)-1 and (5)-2 to (5)-5, (5)-7 and (5)-10, respectively, in Example 1. The results are shown in Table-1.

Example 5

A photoreceptor was produced and evaluated in the same manner as in Example-1 except for changing the charge transport substance (1)-2 to (1)-4 in Example 1. The results are shown in Table 1.

Example 6

A photoreceptor was produced and evaluated in the same manner as in Example-1 except for changing the charge transport substance (2)-4 to (2)-12 in Example 1. The results are shown in Table 1.

Example 7

A photoreceptor was produced and evaluated in the same manner as in Example 1 except for changing the binder resin (B-1) to a polycarbonate resin (viscosity average molecular weight: 40,000) having a repeating structural unit represented by the following (B-3) in Example 1. The results are shown in Table-1.

(B-3)

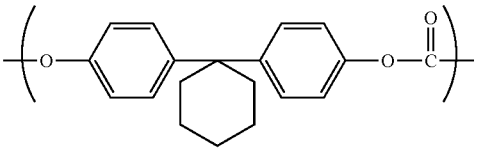

Examples 8 to 10

Photoreceptors were produced and evaluated in the same manner as in Example 8 except for changing the mixture of (5)-1 and (5)-2 to (5)-5, (5)-7 and (5)-10, respectively, in Example 8. The results are shown in Table-1.

Comparative Example 1

A photoreceptor was produced and evaluated in the same manner as in Example 1 except for not using the mixture of (5)-1 and (5)-2 in Example 1. The results are shown in Table-1.

Comparative Example 2

A photoreceptor was produced and evaluated in the same manner as in Example 1 except for changing the mixture of (5)-1 and (5)-2 to the following (E-1) in Example 1. The results are shown in Table-1.

(E-1)

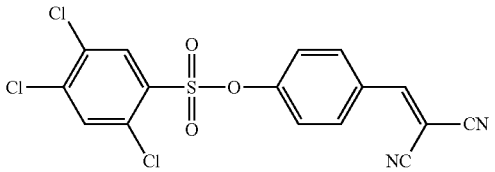

Comparative Example 3

A photoreceptor was produced and evaluated in the same manner as in Example 1 except for changing the mixture of (5)-1 and (5)-2 to the following (E-2) in Example 1. The results are shown in Table-1.

(E-2)

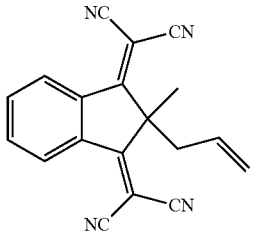

Comparative Example 4

A photoreceptor was produced and evaluated in the same manner as in Example 8 except for not using the mixture of (5)-1 and (5)-2 in Example 8. The results are shown in Table-1.

Comparative Example 5

A photoreceptor was produced and evaluated in the same manner as in Example 8 except for changing the mixture of (5)-1 and (5)-2 to (E-1) in Example 8. The results are shown in Table-1.

Comparative Example 6

A photoreceptor was produced and evaluated in the same manner as in Example 1 except for changing 2 parts of the mixture of (5)-1 and (5)-2 to 20 parts of the following (E-4) in Example 1. The results are shown in Table-1. Incidentally, the following (E-4) is smaller in the ionization potential value by about 0.4 eV than (1)-2 and (2)-4.

(E-4)

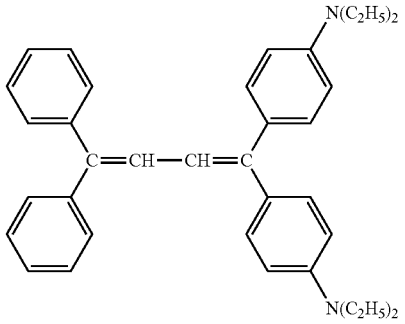

Comparative Example 7

A photoreceptor was produced and evaluated in the same manner as in Example 1 except for changing the mixture of (5)-1 and (5)-2 to the following (E-5) in Example 1. The results are shown in Table-1.

(E-5)

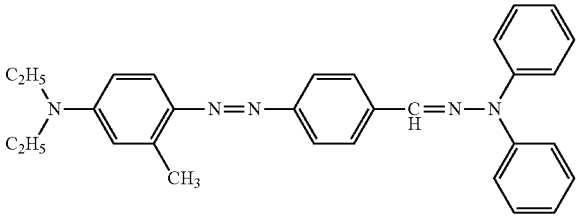

Comparative Example 8

A photoreceptor was produced and evaluated in the same manner as in Example 1 except for changing the mixture of (5)-1 and (5)-2 to the following (E-6) (another name: C.I. Disperse Orange 5) in Example 1. The results are shown in Table-1.

(E-6)

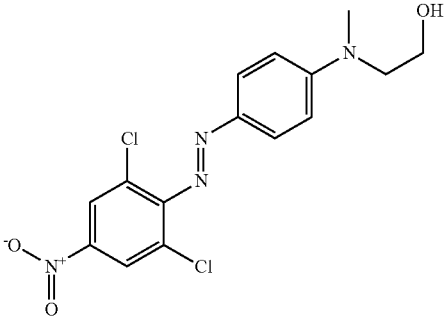

Comparative Example 9

A photoreceptor was produced and evaluated in the same manner as in Example-1 except for changing the charge transport substance (2)-4 to the charge transport substance represented by the following (A) in Example 1. The results are shown in Table-1.

(A)

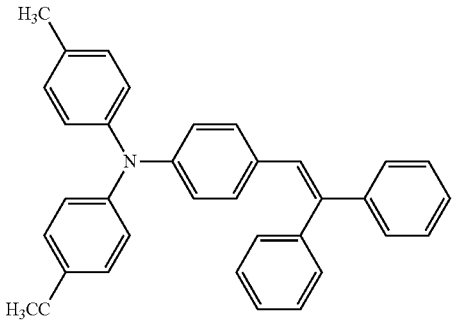

Comparative Example 10

A photoreceptor was produced and evaluated in the same manner as in Example-1 except for changing the charge transport substance (1)-2 to the charge transport substance represented by the following (B) in Example 1. The results are shown in Table-1.

(B)

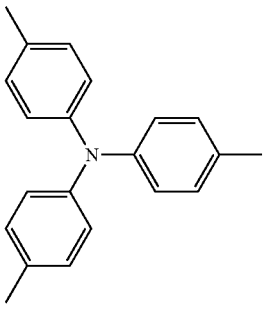

TABLE 1

| | Charge Transport Substance (6) | Charge Transport Substance (2) | Additive (5) | Binder Resin |
|---|---|---|---|---|
| Example 1 | (1)-2 | (2)-4 | (5)-1/(5)-2 | B-1 |
| Example 2 | (1)-2 | (2)-4 | (5)-5 | B-1 |
| Example 3 | (1)-2 | (2)-4 | (5)-7 | B-1 |
| Example 4 | (1)-2 | (2)-4 | (5)-10 | B-1 |
| Example 5 | (1)-4 | (2)-4 | (5)-1/(5)-2 | B-1 |
| Example 6 | (1)-2 | (2)-12 | (5)-1/(5)-2 | B-1 |
| Example 7 | (1)-2 | (2)-4 | (5)-1/(5)-2 | B-3 |
| Example 8 | (1)-2 | (2)-4 | (5)-5 | B-3 |
| Example 9 | (1)-2 | (2)-4 | (5)-7 | B-3 |
| Example 10 | (1)-2 | (2)-4 | (5)-10 | B-3 |
| Comparative Example 1 | (1)-2 | (2)-4 | — | B-1 |

TABLE 1-continued

| | | | | |
|---|---|---|---|---|
| Comparative Example 2 | (1)-2 | (2)-4 | E-1 | B-1 |
| Comparative Example 3 | (1)-2 | (2)-4 | E-2 | B-1 |
| Comparative Example 4 | (1)-2 | (2)-4 | — | B-3 |
| Comparative Example 5 | (1)-2 | (2)-4 | E-1 | B-3 |
| Comparative Example 6 | (1)-2 | (2)-4 | E-3 | B-1 |
| Comparative Example 7 | (1)-2 | (2)-4 | E-4 | B-1 |
| Comparative Example 8 | (1)-2 | (2)-4 | E-5 | B-1 |
| Comparative Example 9 | (1)-2 | A | (5)-1/(5)-2 | B-1 |
| Comparative Example 10 | B | (2)-4 | (5)-1/(5)-2 | B-1 |

| | VL Before Exposure to Light (−V) | ΔVH Immediately after Exposure to Light (−V) | ΔVL1 Immediately After Exposure to Light (−V) | ΔVL2 After Standing Overnight (−V) | ΔVL3 When Repeated After Standing Overnight (−V) |
|---|---|---|---|---|---|
| Example 1 | 109 | −3 | −4 | −2 | 1 |
| Example 2 | 113 | −5 | −8 | −5 | 5 |
| Example 3 | 114 | −2 | 17 | 4 | 6 |
| Example 4 | 135 | −4 | −9 | −2 | −1 |
| Example 5 | 104 | −2 | −4 | −3 | 3 |
| Example 6 | 105 | −2 | −3 | −1 | 3 |
| Example 7 | 53 | −5 | −2 | −4 | 1 |
| Example 8 | 52 | −7 | −4 | −3 | 4 |
| Example 9 | 52 | 4 | 24 | 8 | 10 |
| Example 10 | 70 | 0 | −4 | −2 | 1 |
| Comparative Example 1 | 98 | −52 | −49 | −12 | −3 |
| Comparative Example 2 | 113 | −294 | −53 | −53 | 12 |
| Comparative Example 3 | 135 | −22 | −32 | −7 | 1 |
| Comparative Example 4 | 45 | −28 | −23 | −20 | 1 |
| Comparative Example 5 | 56 | −111 | −18 | −20 | 10 |
| Comparative Example 6 | 142 | −59 | −55 | −29 | 112 |
| Comparative Example 7 | 121 | −10 | −9 | −9 | 53 |
| Comparative Example 8 | 138 | −23 | −18 | −16 | 85 |
| Comparative Example 9 | 152 | −20 | −15 | −13 | 20 |
| Comparative Example 10 | 133 | −18 | −20 | −13 | 15 |

*In Table 1, the charge transport substances (A) and (B) used for comparison do not have a chemical structure represented by formula (2) or (6) but for the sake of convenience, are placed in the columns of Charge Transport Substances (2) and (6).

As seen from Table-1, the photoreceptors of Examples of this application show a small potential variation after exposure to white fluorescent light and at the same time, show a small potential variation even in repeated use after exposure to light. On the other hand, when the additive represented by formula (5) is not used, the photoreceptor is greatly reduced in the potential after exposure to light or shows a large potential rise in repeated use after exposure to light. Furthermore, even when the additive represented by formula (5) is used, the effect is small depending on the charge transport substance.

Example 11

Production of Photoreceptor Drum

On an aluminum-made cylinder having a rough cut finished and cleanly washed surface and having an outer diameter of 30 mm, a length of 260.5 mm and a wall thickness of 0.75 mm, the coating solution for undercoat layer formation, the coating solution for charge generation layer formation, and the coating solution for charge transport layer formation each used for the production of the photoreceptor of Example 1 were successively coated by a dip coating method and dried to form a undercoat layer, a charge generation layer and a charge transport layer having a dry thickness of 1.3 μm, 0.4 μm, and 25 μm, respectively, whereby a photoreceptor drum was produced. Incidentally, drying of the charge transport layer was performed at 125° C. for 20 minutes.

<Image Test>

The image test was performed using a tandem-type color laser printer HP Color LaserJet 4650 manufactured by Hewlett-Packard Co. The produced photoreceptor drum (four drums equivalent in quality) was loaded in a process cartridge for each of cyan, magenta, yellow and black colors and after mounting this cartridge in the printer above, an image formation test on 8,000 sheets was performed in an environment at a temperature of 25° C. and a humidity of 50%. As a result, although slight filming was generated, an image defect due to ghost, fogging, density reduction, cleaning failure, scratch or the like was not produced, and a good image was obtained. Also, when an image formation test on 1,000 sheets was further performed in an environment at a temperature of 10° C. and a humidity of 15%, a slight density reduction was observed. Furthermore, after returning to an environment at a temperature of 25° C. and a humidity of 50%, a part of the photoreceptor drum was exposed to white fluorescent light in the same manner as above, but an image density change was not observed.

Example 12

Production of Photoreceptor Drum

A photoreceptor drum was produced in the same manner as in Example 11 except for using the following coating solution as the coating solution for charge generation layer.

<Production of Coating Solution for Charge Generation Layer Formation>

Figure 2:
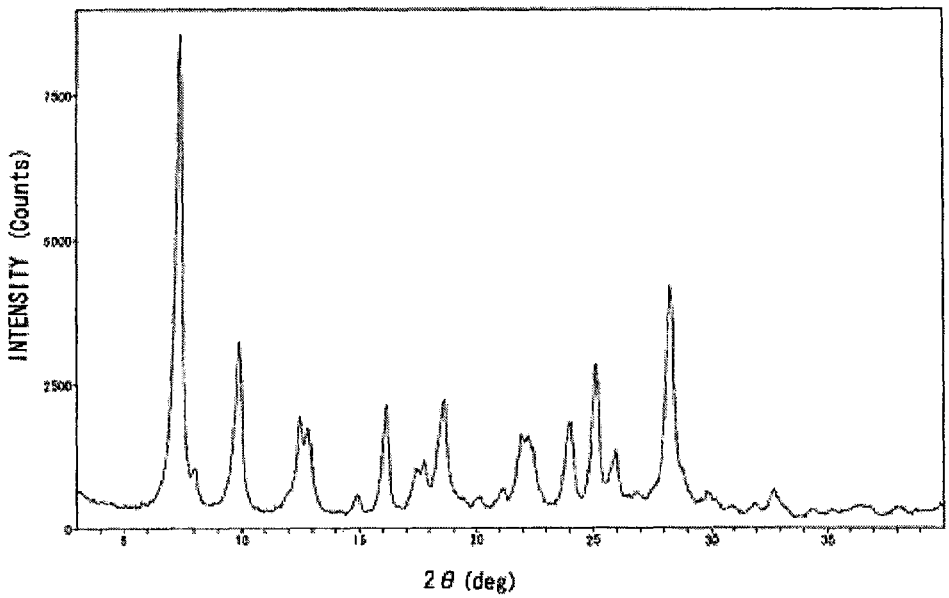
FIG. 2 is a powder X-ray diffraction spectrum of V-type hydroxygallium phthalocyanine used in the present invention.

20 Parts of V-type hydroxygallium phthalocyanine exhibiting a diffraction spectrum shown in FIG. 2 in X-ray diffraction by CuKα ray was mixed as a charge generating substance with 280 parts of 1,2-dimethoxyethane, and the mixture was ground in a sand grinding mill for 1 hour to perform a pulverization/dispersion treatment. This pulverization-treated solution was mixed with a binder solution obtained by dissolving 10 parts of polyvinylbutyral ("Denka Butyral" #6000C, trade name, produced by Denki Kagaku Kogyo K.K.) in a mixed solution of 255 parts of 1,2-dimethoxyethane and 85 parts of 4-methoxy-4-methyl-2-pentanone and with 230 parts of 1,2-dimethoxyethane to prepare a coating solution for charge generation layer formation.

<Image Test>

The image test was performed using a tandem-type color laser printer HP Color LaserJet 4650 manufactured by Hewlett-Packard Co. similarly to Example 11. First, an image formation test on 8,000 sheets was performed in an environment at a temperature of 25° C. and a humidity of 50%. As a result, although slight filming was generated, an image defect due to ghost, fogging, density reduction, cleaning failure, scratch or the like was not produced, and a good image was obtained. Also, when an image formation test on 1,000 sheets was further performed in an environment at a temperature of 10° C. and a humidity of 15%, a density reduction was not observed. Furthermore, after returning to an environment at a temperature of 25° C. and a humidity of 50%, a part of the photoreceptor drum was exposed to white fluorescent light in the same manner as above, but an image density change was not observed.

Example 13

Production of Photoreceptor Drum

A photoreceptor drum was produced in the same manner as in Example 11 except that the coating solution used for the production of photoreceptor of Example 8 was used as the coating solution for charge transport layer.

<Image Test>

The image test was performed using a tandem-type color laser printer HP Color LaserJet 4650 manufactured by Hewlett-Packard Co. similarly to Example 11. First, an image formation test on 8,000 sheets was performed in an environment at a temperature of 25° C. and a humidity of 50%. As a result, although slightly severer filming than in Examples 13 and 14 was generated, an image defect due to ghost, fogging, density reduction, cleaning failure, scratch or the like was not produced, and a good image was obtained. However, the loss in the film thickness of the photosensitive layer after printing was about 2 times larger than in Examples 13 and 14. Also, when an image formation test on 1,000 sheets was further performed in an environment at a temperature of 10° C. and a humidity of 15%, a slight density reduction was observed. Furthermore, after returning to an environment at a temperature of 25° C. and a humidity of 50%, a part of the photoreceptor drum was exposed to white fluorescent light in the same manner as above, but an image density change was not observed.

Comparative Example 11

A photoreceptor drum was produced in the same manner as in Example 11 except that the coating solution for charge transport layer used in the production of photoreceptor of Comparative Example 1 was used in place of the coating solution for charge transport layer used in the production of photoreceptor of Example 11. First, an image formation test on 8,000 sheets was performed in an environment at a temperature of 25° C. and a humidity of 50%. As a result, slight filming was generated, and a density reduction was observed. Also, when an image formation test on 1,000 sheets was further performed in an environment at a temperature of 10° C. and a humidity of 15%, a great density reduction was observed. Furthermore, after returning to an environment at a temperature of 25° C. and a humidity of 50%, a part of the photoreceptor drum was exposed to white fluorescent light in the same manner as above, as a result, a significant image density rise was observed only in the irradiated portion and even after standing overnight, the rise was still observed.

This application is based on Japanese patent application JP 2012-048019, filed on Mar. 5, 2012, the entire content of which is hereby incorporated by reference, the same as if set forth at length.

What is claimed is:

1. A laminate-type electrophotographic photoreceptor for use in a negative charge system, comprising:

a conductive support; and a photosensitive layer;

wherein the photosensitive layer comprises:

a charge generation layer and a charge transport layer, the charge transport layer comprises in the same layer:

(i) a charge transport substance of formula (2), (2)

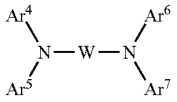

wherein $Ar^4$ to $Ar^7$ are each independently an aryl group having a carbon number of 30 or less, which may have a substituent, and W is a divalent substituent of formula (3) or (4);

(3)

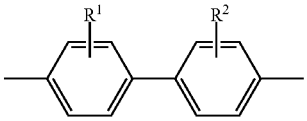

(4)

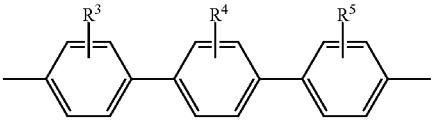

wherein $R^1$ to $R^5$ are each independently a hydrogen atom or an alkyl group having a carbon number of 6 or less, and the substituents in $Ar^4$ to $Ar^7$ may combine with each other to form a ring;

(ii) a charge transport substance of formula (6), (6)

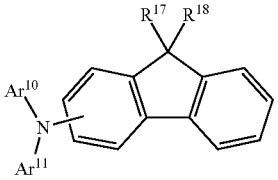

wherein $Ar^{10}$ and $Ar^{11}$ are each independently an aryl group having a carbon number of 30 or less, which may have a substituent, and $R^{17}$ and $R^{18}$ are each independently a hydrogen atom or an alkyl group having a carbon number of 6 or less; and (iii) at least one compound selected from the group consisting of formulas (5a)

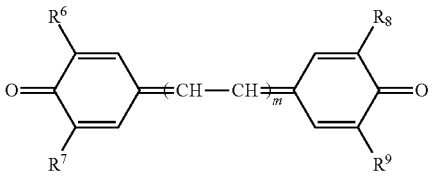

wherein $R^6$ to $R^9$ are each independently an alkyl group having a carbon number of 6 or less, and m is 0 or 1;

(5b)

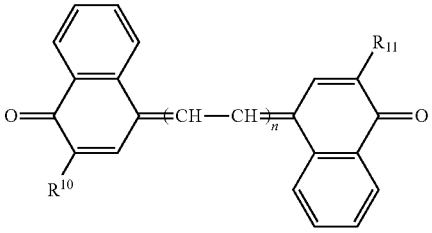

wherein $R^{10}$ and $R^{11}$ are each independently an alkyl group having a carbon number of 6 or less, and n represents 0 or 1; and (5c)

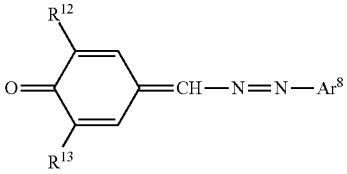

wherein $R^{12}$ and $R^{13}$ are each independently an alkyl group having a carbon number of 6 or less, and $Ar^8$ is an aryl group having a carbon number of 30 or less, which may have a substituent, and wherein the photosensitive layer comprises a polyester resin having a structural unit of formula (7):

(7)

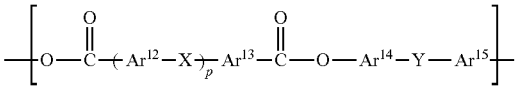

wherein each of $Ar^{12}$ to $Ar^{15}$ independently represents an arylene group which may have a substituent, X represents a single bond, an oxygen atom, a sulfur atom or an alkylene group, p represents an integer of 0 to 2, and Y represents a single bond, an oxygen atom, a sulfur atom or an alkylene group.

2. The laminate-type electrophotographic photoreceptor of claim 1, wherein the photosensitive layer further comprises gallium phthalocyanine as a charge generating substance.

3. An electrophotographic photoreceptor cartridge comprising:

the laminate-type electrophotographic photoreceptor of claim 1; and at least one member selected from the group consisting of a charging device for charging said electrophotographic photoreceptor, an exposure device for exposing said charged laminate-type electrophotographic photoreceptor to form an electrostatic latent image, and a developing device for developing the electrostatic latent image formed on said laminate-type electrophotographic photoreceptor.

4. An image forming apparatus comprising:

the laminate-type electrophotographic photoreceptor of claim 1;

a charging device for charging said laminate-type electrophotographic photoreceptor;

an exposure device for exposing said charged laminate-type electrophotographic photoreceptor to form an electrostatic latent image; and a developing device for developing the electrostatic latent image formed on said laminate-type electrophotographic photoreceptor.

5. The laminate-type electrophotographic photoreceptor of claim 1, wherein a total amount of the charge transport substances of formulas (2) and (6) is from 40 to 150 parts by weight per 100 parts by weight of the binder resin.

6. The laminate-type electrophotographic photoreceptor of claim 1, wherein a weight ratio of the charge transport substance of formula (6) to the charge transport substance of formula (2) is from 20/80 to 95/5.

7. The laminate-type electrophotographic photoreceptor of claim 1, wherein a total amount of the compound of formulas (5a-5c) is from 0.01 to 50 parts by weight per 100 parts by weight of the binder resin.

8. The laminate-type electrophotographic photoreceptor of claim 1, wherein the photosensitive layer further comprises at least one selected from the group consisting of an antioxidant, a plasticizer, an ultraviolet absorber, an electron-withdrawing compound, a leveling agent and a visable light-shielding agent.

* * * * *